US005675104A

United States Patent [19]

Schorr et al.

[11] Patent Number: 5,675,104

[45] Date of Patent: Oct. 7, 1997

[54] AERIAL DEPLOYMENT OF AN EXPLOSIVE ARRAY

[75] Inventors: David J. Schorr, Austin; Les H. Richards, Temple; James K. Vinson; Lex N. Allen, both of Austin, all of Tex.

[73] Assignee: Tracor Aerospace, Inc., Austin, Tex.

[21] Appl. No.: 551,882

[22] Filed: Oct. 24, 1995

Related U.S. Application Data

[63] Continuation-in-part of Ser. No. 328,255, Oct. 24, 1994, Pat. No. 5,524,524.

[51] Int. Cl.[6] ..... F42B 22/24

[52] U.S. Cl. ..... 89/1.13; 89/1.11; 102/403

[58] Field of Search ..... 89/1.1, 1.11, 1.13; 102/402, 403; 244/153 R, 154; 342/5, 7, 8, 9

[56] References Cited

U.S. PATENT DOCUMENTS

| | | | |
|---|---|---|---|
| 1,757,788 | 5/1930 | West . | |
| 2,433,875 | 1/1948 | Walker et al. | 102/22 |
| 2,455,354 | 12/1948 | Bisch | 102/22 |
| 2,509,205 | 5/1950 | Bisch | 102/22 |
| 2,771,841 | 11/1956 | De Fino | 102/22 |
| 2,805,065 | 9/1957 | Cotton | 342/9 |
| 2,828,008 | 3/1958 | Fryburger | 206/65 |
| 2,842,263 | 7/1958 | Giraudet | 206/65 |
| 2,881,914 | 4/1959 | Woeber et al. | 206/65 |
| 2,973,164 | 2/1961 | Grill | 244/14 |
| 3,087,427 | 4/1963 | Thorildsson | 102/34.1 |
| 3,088,403 | 5/1963 | Bartling et al. | 102/7 |
| 3,183,835 | 5/1965 | Bisch | 102/19 |
| 3,242,862 | 3/1966 | Stegbeck et al. | 102/22 |
| 3,268,016 | 8/1966 | Bell | 175/4.51 |
| 3,486,178 | 12/1969 | Savage | 9/14 |
| 3,568,191 | 3/1971 | Hiester et al. | 342/8 |
| 3,638,569 | 2/1972 | Thomanek | 102/22 |

(List continued on next page.)

FOREIGN PATENT DOCUMENTS

| | | |
|---|---|---|
| 0 040 835 A1 | 12/1981 | European Pat. Off. . |
| 0 295 326 A1 | 12/1988 | European Pat. Off. . |
| 2226064 | 11/1974 | France . |
| 2 235 347 | 1/1975 | France . |
| 2 664 688 A1 | 1/1992 | France . |
| 3619332 | 12/1987 | Germany . |
| 40 24 112 A1 | 2/1992 | Germany . |
| 452143 | 8/1936 | United Kingdom . |
| 1 604 011 | 12/1981 | United Kingdom . |
| 2 101 094 A | 1/1983 | United Kingdom . |
| 2 166 225 A | 4/1986 | United Kingdom . |

OTHER PUBLICATIONS

Technical Reports on "Improved Dispersed Explosive (IDX)," Distributed Explosive Mine Neutralization System (DEMNS), and Standoff Minefield Breacher (SMB), name and date of publication unknown.

Published description of Mineclearing Line Charge M58/M59 (MICLIC), name and date of publication unknown.

Published description of Giant Viper Anti-tank Mineclearing Equipment, name and date of publication unknown.

Brochure describing Titan shaped charge penetrator, name and date of publication unknown.

"Best Technical Approach Analysis (BTA) for the Standoff Minefield Breaching Capability (SMBC)," Final Report prepared for U.S. Army Belvoir Research, Development and Engineering Center, Nov. 22,1993.

*Primary Examiner*—Michael J. Carone
*Assistant Examiner*—Theresa M. Wesson
*Attorney, Agent, or Firm*—Arnold, White & Durkee

[57] ABSTRACT

The present invention pertains to the aerial deployment of generally planar structures. Typically, these structures are explosive arrays. Such explosive arrays are typically used in standoff minefield clearing and breaching on the ground, at river crossings, on beaches, and in shallow water surf zones adjoining beaches. The invention more specifically involves devices and methods for stably deploying such structures. This stable deployment is achieved by positioning the structure in a dihedral configuration as it moves through the air.

44 Claims, 16 Drawing Sheets

U.S. PATENT DOCUMENTS

| | | | |
|---|---|---|---|
| 3,648,613 | 3/1972 | Cunn | 102/22 |
| 3,724,319 | 4/1973 | Zabelka et al. | 89/1 M |
| 3,965,993 | 6/1976 | Lavigne et al. | 175/4.6 |
| 4,051,763 | 10/1977 | Thomanek | 89/36 R |
| 4,228,737 | 10/1980 | Kahn et al. | 102/3 |
| 4,296,894 | 10/1981 | Schnäbele et al. | 244/3.27 |
| 4,381,057 | 4/1983 | Carver | 206/434 |
| 4,583,641 | 4/1986 | Gelzer | 206/330 |
| 4,742,977 | 5/1988 | Crowell | 244/153 R |
| 4,768,417 | 9/1988 | Wright | 89/1.11 |
| 4,776,255 | 10/1988 | Smith | 89/1.13 |
| 4,823,672 | 4/1989 | Eidelman | 89/1.13 |
| 4,829,900 | 5/1989 | Van der Westhuizen et al. | 102/303 |
| 4,896,845 | 1/1990 | Peretti et al. | 244/3.1 |
| 4,967,636 | 11/1990 | Murray et al. | 89/1.13 |
| 5,063,822 | 11/1991 | Lopez de Cardenas | 89/1.15 |
| 5,099,747 | 3/1992 | Smith | 89/1.13 |
| 5,141,175 | 8/1992 | Harris | 244/3.25 |
| 5,323,683 | 6/1994 | Dilhan et al. | 89/1.13 |
| 5,333,814 | 8/1994 | Wallis | 89/1.11 |
| 5,417,139 | 5/1995 | Boggs et al. | 89/1.11 |
| 5,437,230 | 8/1995 | Harris et al. | 102/302 |
| 5,524,524 | 6/1996 | Richards et al. | 89/1.13 |

30
31
31
32
33
35

31
32
33
34
36
38

31
31
36
38
35

Section A/A

AERIAL DEPLOYMENT OF AN EXPLOSIVE ARRAY

This application is a continuation-in-part of U.S. patent application Ser. No. 08/328,255 now U.S. Pat. No. 5,524,524, filed Oct. 24, 1994.

BACKGROUND OF THE INVENTION

I. Field of the Invention

The present invention pertains to the aerial deployment of generally planar structures. Typically, these structures are net-type explosive arrays. Such explosive arrays are used in standoff minefield clearing and breaching on the ground, at river crossings, on beaches, and in shallow water surf zones adjoining beaches.

II. Review of the Related Art

Minefields represent a major danger to equipment and personnel during military action. Explosive arrays encompassing distributed explosive technologies (DET) provide one mechanism for breaching minefields. The DET array is typically spread over a minefield, or lane to be cleared, from a safe standoff distance and detonated. The explosive detonation is designed to neutralize the mines. Different DET technologies can be employed and some are more efficient than others, however, the intent is to neutralize all mines in the breach lane: surface laid, buried, scattered, or underwater. Some arrays are designed to clear a safe path for armored vehicles and personnel through a minefield. These arrays are much longer than they are wide, i.e., 100 to 150 meters in length by 5 to 8 meters wide. Other arrays are adapted for beach zone area mine clearance applications for amphibious assault operations and require a more square, typically 150 by 150 feet, Beach Zone Array (BZA) to clear a Craft Landing Zone (CLZ).

Several explosive configurations are known for use in DET. The simplest of these can consist of a simple matrix of detonation cord, in some cases interwoven with reinforcing plastic rope. In such devices, the explosive force is generated only by the explosion of detonating cord. This explosive force is typically too small to allow for reliable neutralization of mines on land, because detonating cord can not generate enough over-pressure on a buried mine to cause neutralization. A mine is considered neutralized when the main charge is detonated, deflagrated, broken up, or otherwise neutralized. However, detonating cord nets do have some application in arrays for use in surf zones and rivers, where the pressure of water over the deployed net can direct the explosive force toward the buried mines.

In the attempt to obtain greater explosive pressure on the mines, some have disposed arrays of individual explosive packages in net-type structures. An example of this is seen in U.S. Pat. No. 3,242,862 to Stegbeck et al. However, even these individual explosive packets often do not provide enough pressure to reliably neutralize a minefield. Various other explosive strings and arrays are described in U.S. Pat. No. 5,417,139, issued to Boggs et al. The problems of non-directed arrays, i.e., those that simply employ explosives to attempt to create overpressure on mines is exacerbated by the development of mines with sophisticated fusing mechanisms that can survive the pressure such a preemptive strike and then explode under a desired target.

In order to overcome the lack of mine neutralizing power of most non-directed explosives, arrays of discrete distributed shaped charge explosives have been developed. Such arrays have been developed, inter alia as part of the Distributed Explosive Mine Neutralization System (DEMNS)

Advanced Technology Demonstration program developed by Indian Head Division, Naval Surface Warfare Center. DEMNS is described in Preliminary Design and Accuracy Analysis of a Ground-Launched Multiple Rocket System For Breaching Mine Fields (NTIS Accession No. AD-A061 672). DEMNS is designed to neutralize all surface laid and buried mines regardless of fusing and employs an explosive array concept which relies on a rocket deployed net and small shaped charge munitions to neutralize the minefield. Individual munitions weighing approximately 50 grams each are attached to the net in a square lattice pattern at about 6.6 inch lateral and longitudinal spacing. Upon detonation, each shaped charge fires a penetrating jet of metal into the ground that will detonate, deflagrate, break-up or otherwise neutralize the underlying mine regardless of mine fusing. Detonation cord is routed to each munition to provide an initiation input.

The penetrating shaped charge munitions provide highly directional penetrating jets, which are intended to be pointed directly downward into the ground. Using statistical methods, based on the known sizes of the mines that are likely to be present in a given minefield, spaced arrays comprising thousands of penetrating munitions may be designed with an optimum spacing between munitions to achieve a desired neutralization effectiveness. The design methods assume that the munitions will be deployed pointing downward. If the orientation of the munitions is not adequately controlled, then mines may be missed, and the designed effectiveness of the system will not be achieved.

Early efforts at the DEMNS systems employed a rope net where the munitions were suspended at the intersections of longitudinal and lateral ropes, in such a way that tension in the ropes caused the munitions to be oriented normal to the plane of the net. This system had difficulty in practice, the DEMNS net could not be adequately tensioned to assure that the munitions were properly oriented in an upright position spaced and after deployment. Bunching of the net, and the munitions carried thereby, reduced both the size of the area that could be cleared by the system and the effectiveness of the munitions within that area.

Tracor's Integrated Spacing and Orientation Control (ISOC) explosive array, was designed to meet the problems of the DEMNS system. The ISOC system is the subject of U.S. patent application Ser. No. 08/328,255 now U.S. Pat. No. 5,524,524, filed Oct. 24, 1994, the parent of this continuation-in-part application, and is described fully therein. ISOC systems provide spacing and orientation control for the munitions that are used in a penetrating munition array. This provides benefits including 1) maximizing effectiveness for a given munition quantity; 2) maintaining the munition orientation on the ground, suspended in the air, and underwater; and 3) supporting the use of optimum munition grid arrangements and spacing. ISOC provides reliable orientation control while fully supporting and protecting the munition with a high strength, lightweight structure.

Apart from concerns of array construction and the effect of such construction upon munition positioning, there arise a set of concerns dealing with array deployment and its effects on munition positioning. Most applications require the array to be stowed for transport and rapidly deployed under hostile conditions. This requires the array to be stowed in a transportable container whose width (<2.5 meters) is less than the expanded array width (5 to 8 meters). This necessitates that the array be spread, usually in-flight. Prior art techniques have used diverging trajectories of dual rocket motors to spread the net. Further, DEMNS used telescoping tubes to spread the array prior to impact. The DEMNS technique also employs the use of dual rocket motors to keep the front tube assembly level.

Stability in deployment is critical in the DET technologies. Especially those DET systems that involve shaped charge munitions, such as DEMNS, which require orientation, i.e., they fire down into the minefield to neutralize mines. Such structures must be deployed with these shaped charge munitions oriented downward. In addition, even in aerially deployed mine-clearing structures that do not employ directional charges, twisting of the structure prior to impact will compress the width of the cleared path and might not allow path clearance to the desired width. Systems that do not incorporate some form of stability control are not stable and will not deploy properly, i.e., the array will twist in flight and render the system ineffective after impact. Various methods have been employed to attempt to provide this stability.

The DEMNS deployment system is comprised of two tow rocket motors and the expandable net structure comprising a rocket to bridle swivel, a tow bridle assembly, telescoping tube assemblies, a net rope structure, and drag chutes. The net rope structure interfaces to and supports the individual shaped charge munitions, the detonating cord initiation system, and the associated ordnance cables. Standoff (50–75 meters) and the longitudinal net expansion is provided by the combination of the forward thrust of the tow motors and the arresting aerodynamic forces produced by the drag chutes. This dual motor deployment technique is designed to provide in-flight stability to the array (keeping the net horizontal) by flying the motors on slightly diverging trajectories.

In the deployment of the DEMNS system, in-flight lateral expansion (8 meters) of the array is provided by the telescoping tubes. The longitudinal and lateral expansion of the array is essential to spread the munition array over the required breach lane. Drag parachutes attached to the rear of the net structure slow the trajectory until the open net settles over the minefield. Immediately upon settling, the detonation cord is initiated which in turn detonates all of the shaped charge munitions to neutralize the underlying mines.

The diverging trajectories of dual rocket motors have been used to spread distributed explosive nets for surf zone mine neutralization.

There are drawbacks to approaches that employ the diverging trajectories of two rocket motors to keep the array flat, i.e. stable. Analyses and tests show that use of dual rocket motors is a high risk approach. Motor performance anomalies (ignition timing, thrust profile, or launch direction differences) in two motor (DEMNS) type systems can lead to trajectory crossings and array twisting. Indeed, DEMNS deployment tests have incurred such trajectory anomalies, even though the DEMNS deployment tests employed reduced length arrays of only about 88 meters. It is anticipated that full length arrays will accentuate effects arising from differences in the dual rocket motor performances and increase the potential for array twisting. Twisting of the array reduces the effectiveness of the system. A single motor failure in a dual motor system will always prevent effective deployment, and can cause a catastrophic system failure in which the explosive array could land on the host vehicle.

A single tow point aerial deployment system would be advantageous in overcoming these problems inherent in the dual tow point system. However, an effective single tow point system for deploying the explosive arrays necessary to neutralize mines and form a breach path in a minefield has not, heretofore, been available.

One single tow point deployment technique is taught by Stegbeck et al., U.S. Pat. No. 3,242,862, which uses a single rocket motor pulling a discrete charge array. The charges are spread by fixed length spars. This system will not effectively distribute large explosive arrays. The system dimensions are not of a scale that in-flight stability becomes a concern, the systems are relatively short (<100 meters) and narrow (<2 meters) eliminating the need for in-flight expansion. In addition, the explosive charges are clumps of explosives not requiring a specific orientation with respect to the minefield.

Other known single motor tow configurations include the Mine Clearing Line Charge (MICLIC) system and the British Giant Viper system, where a single motor is used to deploy a line charge. The deployment of a line charge does not present in-flight stability concerns, since only a single line of explosive, and not an array is being deployed. Another prior art technique for deployment and spreading of a flexible array is taught by Boggs et al. (U.S. Pat. No. 5,417,139).

Another form of single tow point aerially towed system is used for the towing of banners for advertising at public events, i.e., football games, etc. The single point tow configuration of the banner is stable because the banner is towed in a vertical orientation with the tow harness connected to a rigid pole that is counter weighted at the bottom to orient the attached banner. Such vertical orientations are of little use in the deployment of the arrays of the present invention. The explosive arrays of interest to this invention must be towed in a near horizontal orientation in order to create a predictable path across the minefield.

In view of the above, there is a need for a system that allows for the stable aerial deployment of an explosive array. Preferably, this system will allow for a single tow point.

SUMMARY ON THE INVENTION

The present invention provides a method of towing structures, such as large mine neutralizing explosive arrays, through the air to a target in a horizontally stable manner. In-flight stability is realized by configuring the structure in an aerodynamically stable dihedral during the tow phase of the deployment. The horizontal stability provided by the dihedral provides many advantages over prior systems. A key advantage of the dihedral stabilized array is the many options it allows for in-flight towing, i.e., single rocket motor, single aircraft (glider, RPV, APV, etc.), or dual rocket motors. The invention applies to all types of aerially deployed configurations using both fixed and expandable dihedral configurations for stability, allowing the system to be moved through the air in a stable configuration.

The dihedral configuration provides in-flight stability by providing restoring moments to counteract lateral aerodynamic impulses that would tend to roll the structure. The inventors recognized that a flat structure that is being moved through the air is neutrally stable in roll, i.e., while any induced roll tends to be damped out there is no tendency to restore the array to the horizontal. Therefore, induced rolls can cause tilting and twisting of the structure. If the structure is an explosive array, this instability severely limits the success of deployment and mine neutralization. The dihedral functions such that the array is deployed without twisting and inherently resists roll disturbances. The dihedral concept has been validated in full six degree of freedom deployment simulations.

The dihedral design provides the deploying array with an aerodynamic moment that resists array roll or twist disturbances and keeps the array properly oriented throughout the deployment process. The array dihedral roll stability is analogous to the roll stability provided by the dihedral in an aircraft wing. The aerodynamic forces acting on the array, both drag and lift, resolve into components in the array surface and normal to the array surface. Those components normal to the array surface determine the array's roll stability. The dominant array force— drag—acts along the relative wind vector (not the array surface) and, for local array angles of attack, has a component normal to the array surface.

During rocket array deployment the rocket follows a ballistic (curved) trajectory—bending over under the influence of gravity from its initial launch direction. As the rocket pulls the array from a container the array follows the rocket but tends to retain the original launch direction orientation. This results in it moving through the air with an angle-of-attack. Detailed array deployment simulations show that the array incurs an angle of attack over its entire surface throughout deployment. This angle of attack increases from near zero at the beginning of the array deployment process to large values at end of the deployment event.

The dihedral shape helps prevent rolls from occurring, and corrects any rolls that begin. During a roll-free flight condition, the dihedral sides have equal angles of attack. During a roll, the dihedral results in the dipped side incurring a larger angle of attack than raised side. The angle-of-attack difference results in an imbalance in the forces acting on the two dihedral sides and a moment acting around the array's center of gravity. This aerodynamically induced roll moment acts in opposition to the roll angular disturbance and drives the array roll angle back toward a neutral (zero roll angle) condition.

An additional advantage of the dihedral configuration is the allowance for the use of a single tow point during the deployment of the array. The dihedral configuration allows for the problems incumbent in the use of diverging rockets to maintain stability of the array during deployment. A single rocket motor reduces the susceptibility of the array to slight rocket performance anomalies that could give rise to roll disturbances.

An array deployed in the dihedral configuration of the invention could be ground launched from a container using a rocket motor at a safe standoff distance (50–75 meters) over a minefield to clear a path for a maneuvering force (main battle tanks, armored personnel carriers, etc.) as shown in FIG. 6A, FIG. 6B, FIG. 6C, and FIG. 6D. DET array systems that are launched from remote land bases or aircraft carriers could be fully spread prior to aerial deployment (FIG. 5A, FIG. 5B, and FIG. 5C); however, this deployment method has the disadvantage of a higher drag profile than a system that was towed in a laterally compressed configuration and expanded just prior to impact. An array could be tow deployed (in a laterally compressed configuration to minimize drag) by an aircraft, remotely piloted vehicle (RPV), autonomous glider, etc., from an aircraft carrier or distant land base and delivered to the target. The use of autonomously guided, non-piloted assets for deployment would provide an over-the horizon (many miles of standoff) smart weapon breaching capability, i.e., a "fire and forget" system.

Generally, the present invention comprises an aerially deployable system comprising a dihedral forming system adapted to position the system in a substantially dihedral configuration during deployment. The aerially deployable system may be a mine-neutralizing system having explosives for neutralizing mines. Further, the system may have a motion generating source for moving the system through the air. More particularly, the motion generating source is often a powered towing system.

Preferred embodiments of the present invention are aerially deployable minefield clearing systems comprising an explosive array and at least one dihedral forming member connected to the array. The dihedral forming member is adapted to position the array in a substantially dihedral configuration during deployment. The aerially deployable system will typically have at least two dihedral forming members. In order to position the array in a dihedral position, the dihedral forming member may have a fixed angle section. Alternatively, the dihedral forming member may be hinged. The hinged dihedral forming member may be a lateral expansion device mechanism adapted to use energy from a towing system to position the array in a substantially dihedral configuration during towing. Regardless of the manner in which the dihedral is formed, the dihedral forming member is typically adapted to become substantially straight during landing whereby that the array lays substantially flat, or in a substantially ground-conforming configuration, on landing. The dihedral forming member may comprise a telescoping member that laterally extends during flight.

The explosive array of the present invention often includes individual munitions, which may be jet-type munitions. Preferably, there is a detonating system operatively connected to the munitions, this detonating system may comprise detonating cord. Further, detonating cord may be the sole explosive in the array. In one preferred embodiment, the explosive array is a munition array comprising: an array of jet-type munitions, a generally planar network of flexible upper strapping members connected to the top ends of the munitions, and a generally planar network of lower flexible strapping members connected to the bottom ends of the munitions. In some versions of this system, the upper strapping members are fastened to the lower strapping members at locations between the munitions.

The aerially deployable system of the invention will typically have one or more tow points attached to the explosive array. One of the advantages of the dihedral system is that the aerially deployable system may be deployed by a single tow point attached to the array. The aerially deployable system may be adapted to be towed by an aircraft, for example, a rocket or an airplane. Further, the system may be designed to be deployed from an aircraft. For example, the system may be designed to be pulled out of an aircraft by a drag-generating device attached to the explosive array.

The aerially deployable system may comprise aerodynamic enhancing members operatively linked to the array. Such aerodynamic enhancing members may be panels of material or airfoils. The aerodynamic enhancing members may be attached to the array adjacent a dihedral forming member.

Further, the invention contemplates methods of stably aerially towing a substantially planar body by positioning the body in a substantially dihedral configuration during aerial towing. For example, the present invention contemplates a method of aerially deploying an explosive system which includes the steps of: providing a system comprising at least one dihedral forming system adapted to position the system in a substantially dihedral configuration during deployment; attaching the system to an aircraft; and using the aircraft to deploy the system by positioning the system in a dihedral configuration during deployment.

DETAILED DESCRIPTION OF THE PREFERRED EMBODIMENTS

EXAMPLE 1

Dihedral Deployment Of An Explosive Array

Figure 1:
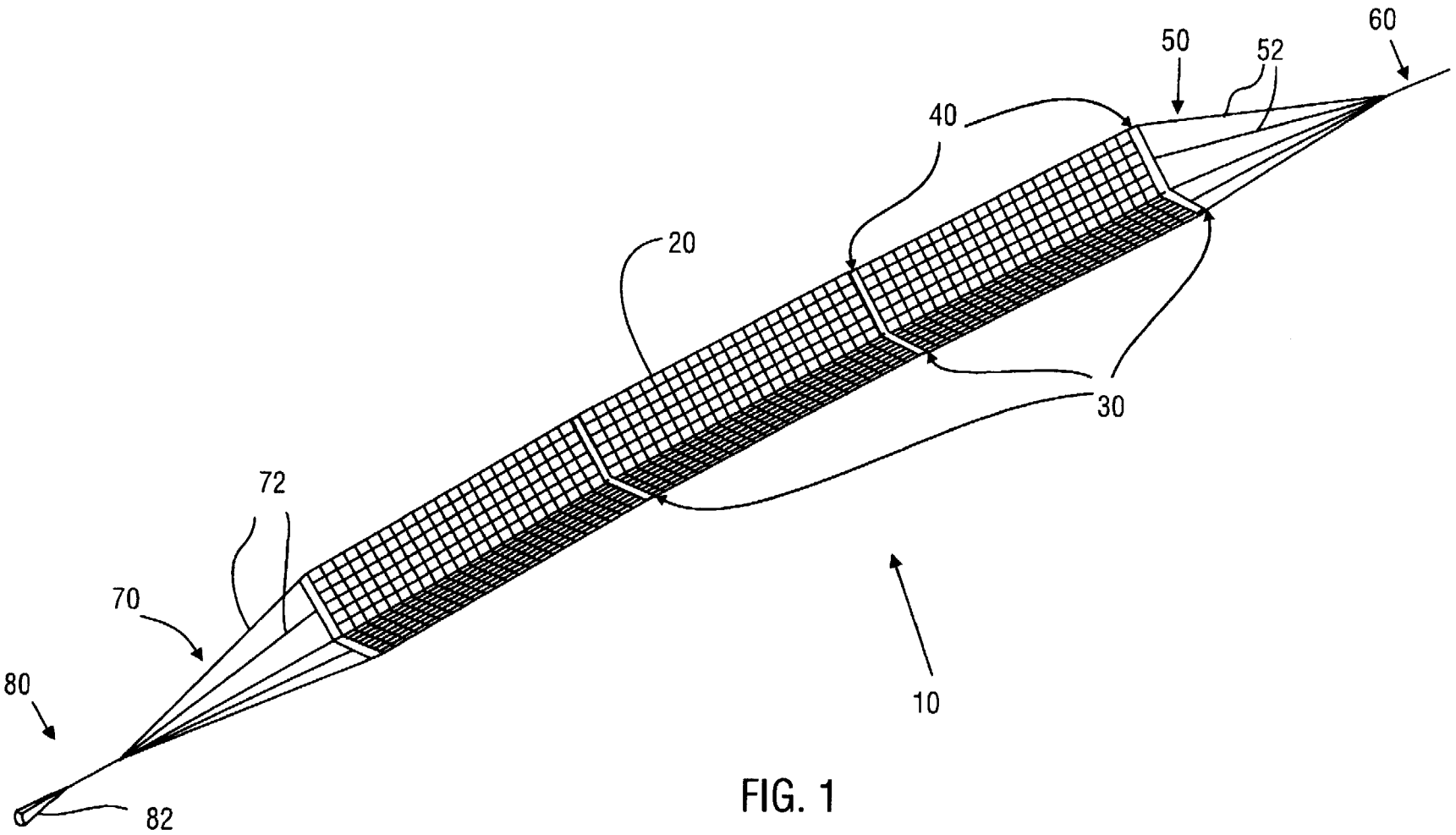
FIG. 1 represents an aerially deployable structure of the present invention in flight.

FIG. 1 shows a configuration of the aerially deployable structure of the present invention.

Aerially deployable mine neutralizing system 10 comprises explosive array 20, with dihedral forming members 30 being operably attached to explosive array 20. Attached to the forward end of explosive array 20 is tow bridle 50, which is comprised of individual tow lines 52. Tow bridle 50 attaches explosive array 20 to aircraft 60. In FIG. 1, aircraft 60 is shown as a single rocket motor. In some configurations, aerodynamic enhancing members 40 may be operably linked to explosive array 20. The purpose of the aerodynamic enhancing members is to provide additional lift as needed during the deployment process and adjust the trim of the net in a manner which compensates for any uncertainties in aerodynamics. The aerially deployable structure may be optionally fitted with drag bridle 70, which is comprised of drag lines 72. Drag bridle 70 is typically attached to drag generating device 80. In FIG. 1, drag generating device 80, comprises drag parachute 82.

Explosive array 20 is typically an open configuration comprised of ropes, cords and/or straps. These members are typically conformed into a net or net-type structure. The net-type structure is employed to support explosives which are to be distributed by the aerially deployable system. The explosives may take the form of detonating cord run along the net structure or comprising part of the net structure, such has been done in the surf zone arrays, which are designed to neutralize mines present in shallow water surf zones and adjoining beach areas. The explosive array may comprise a plurality of individual explosive munitions, as in the DEMNS and ISOC systems. These explosive munitions are designed to provide localized blast of mine-neutralizing energy. Preferably, the munitions are jet-type munitions designed to put a jet of metal into the ground and neutralize the mine. Such shaped charge munitions may be obtained from Tracor Aerospace, Austin, Tex. Typically, detonating cord is employed to detonate the munitions. However, any suitable initiating system can be used to detonate the munitions.

Figure 2:
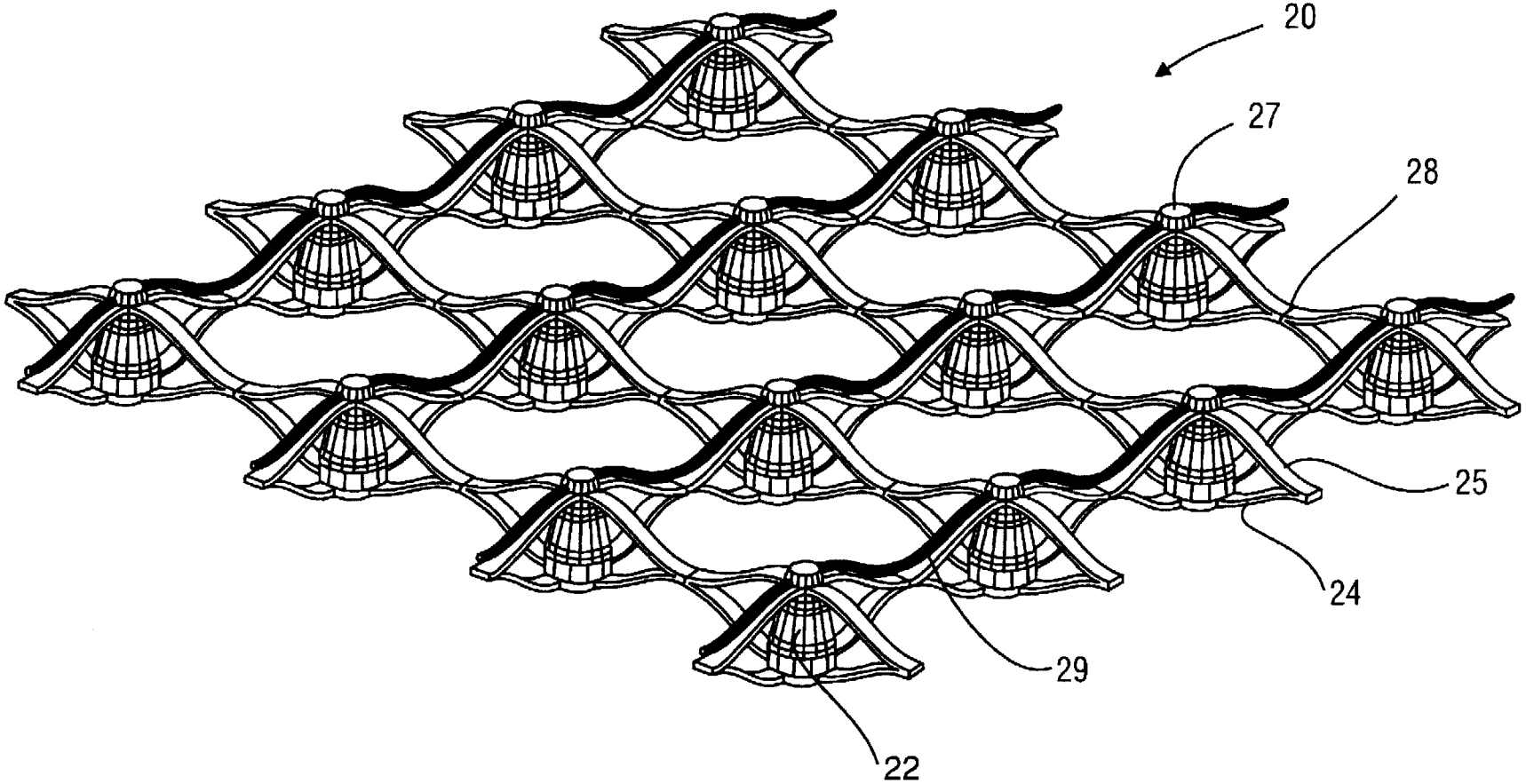
FIG. 2 shows a detailed view of one explosive array that can be deployed using the invention.

FIG. 2 shows a close up of a portion of one embodiment of explosive array 20. FIG. 2 demonstrates one embodiment of the ISOC device, the subject of Applicants' presently pending application, U.S. Ser. No. 08/328,255 now U.S. Pat. No. 5,524,524, filed Oct. 24, 1994. In FIG. 2, one sees a plurality of munitions 22 that have been placed in a net-type structure comprised of lower strapping members 24 and upper strapping members 25. A preferred strapping material for strapping members 24 and 25 is a woven tubular polyester material which can be flattened into a ribbon-like strapping configuration. A suitable material for this purpose is a braided oversleeving that is commercially available from Bently Harris, Lionville, Pa. The sleeving is braided from high tensile strength polyester and nylon filaments. The loose weave makes the sleeving resilient and easy to handle, yet once it is fabricated into the ISOC system, it provides sufficient stiffness and spring rate to lay in a flat panel and exert righting moments on the munitions carried by the system. Other materials may be selected for this application as a matter of design choice. The strapping is preferably flexible enough to be compressed for storage and transport, yet stiff and spring-like to return the elongated condition during deployment of the explosive array. Strapping 24 and 25 is coupled to both the top and bottom of munition 22 so as to control the substantially vertical orientation of each munition 22. Lower strapping 24 may be coupled to upper strapping 25 between munitions 22 by strapping fasteners 28, to form a triangulated structure that operates to properly orient and stabilize the munition assemblies even if the array is not optimally tensioned. Strapping fasteners 28 may comprise stitching, staples, adhesives, or other suitable means. In order to trigger each munition 22 at a desired time, detonating cord 29 is connected to each munition 22. In FIG. 2, each munition 22 comprises a top cap 27 which secures the upper strapping 25 and the detonating cord 29 to the top end of the munition.

Explosive array 20 is operably connected to at least one dihedral forming member 30. Typically, a plurality of dihedral forming members 30 is employed. Typically, two to thirty dihedral forming members may be employed in a standard mine neutralizing array. The number of dihedral forming devices employed is dependent upon the length of the array, along with various other factors such as the stiffness of the array and the width of the array.

Dihedral forming members 30 can be of any of a number of designs. Dihedral forming member 30 is typically a spar which provides a mechanism for erecting and/or holding the explosive array in a laterally spread position. Dihedral forming member 30 is typically a rigid structure, which is adapted to be positioned in a substantially angular position during the deployment of aerially deployable mine neutralizing system 10. The angle of the dihedral forming member functions with the tensions in the explosive array to form the explosive array into the desired aerodynamic dihedral configuration. The angle of the dihedral forming member may be fixed during deployment, or the dihedral forming member may be hinged and connected to the array in such a manner that the angle is controlled by tensions within the explosive array during deployment. As seen in Example 3, a combination of the configuration of tow bridle 50 with a lateral expansion device-type dihedral forming member 30 can result in a dihedral positioning of the explosive array during deployment.

Various configurations of dihedral forming members 30 are possible. The dihedral forming members 30 may be fully spread prior to deployment, i.e., formed during manufacture to be the full width of the array to be deployed. In other embodiments, a compressed dihedral forming member 30 is designed so that it elongates during the deployment of the array and affects the lateral spreading of a compressed explosive array during deployment. Storage and transportability are facilitated by the initially compressed configuration.

Various configurations of dihedral forming members 30 which can expand during deployment exist. Various devices for affecting lateral expansion of explosive arrays have been proven in systems not employing the advantageous dihedral configuration of the present system. These can be adapted and improved to form dihedral forming members of the present invention by incorporation of an appropriate angle into a fixed angle section of the structure. Such dihedral forming members include: (1) telescoping tubes fixed at an angle, (which may be powered by either gas generators, rocket motors or mechanical means); (2) inflatable spars fixed in an appropriate angle such as those demonstrated in some of the DEMNS tests; and (3) lateral expansion device-type dihedral forming members (LED-type dihedral forming members), and hinged spars which are formed into an angle with a sequence system which takes advantage of the energy generated by an aircraft towing the aerially deployed structure and forward inertia to laterally expand the net. Inflatable spars have been demonstrated in the DEMNS system. In the LED-type system the forward energy is conveyed to the explosive array and LED-type dihedral forming members 30 by the use of a configured tow bridle 50. The LEDs are hinged, and the forces of the forward energy are harnessed by the tow bridle to form the LED into an appropriate angle for dihedral deployment. A drag chute can be used in combination with a drag bridle 70 to straighten the lateral expansion devices at a desired time. This system is explained in greater detail in Example 3. The dihedral forming members described above can be made in a manner to allow for rapid submersion of a deployed mine neutralizing device in water for riverine and surf zone breaching applications.

Figures 3A, 3B, 3C:
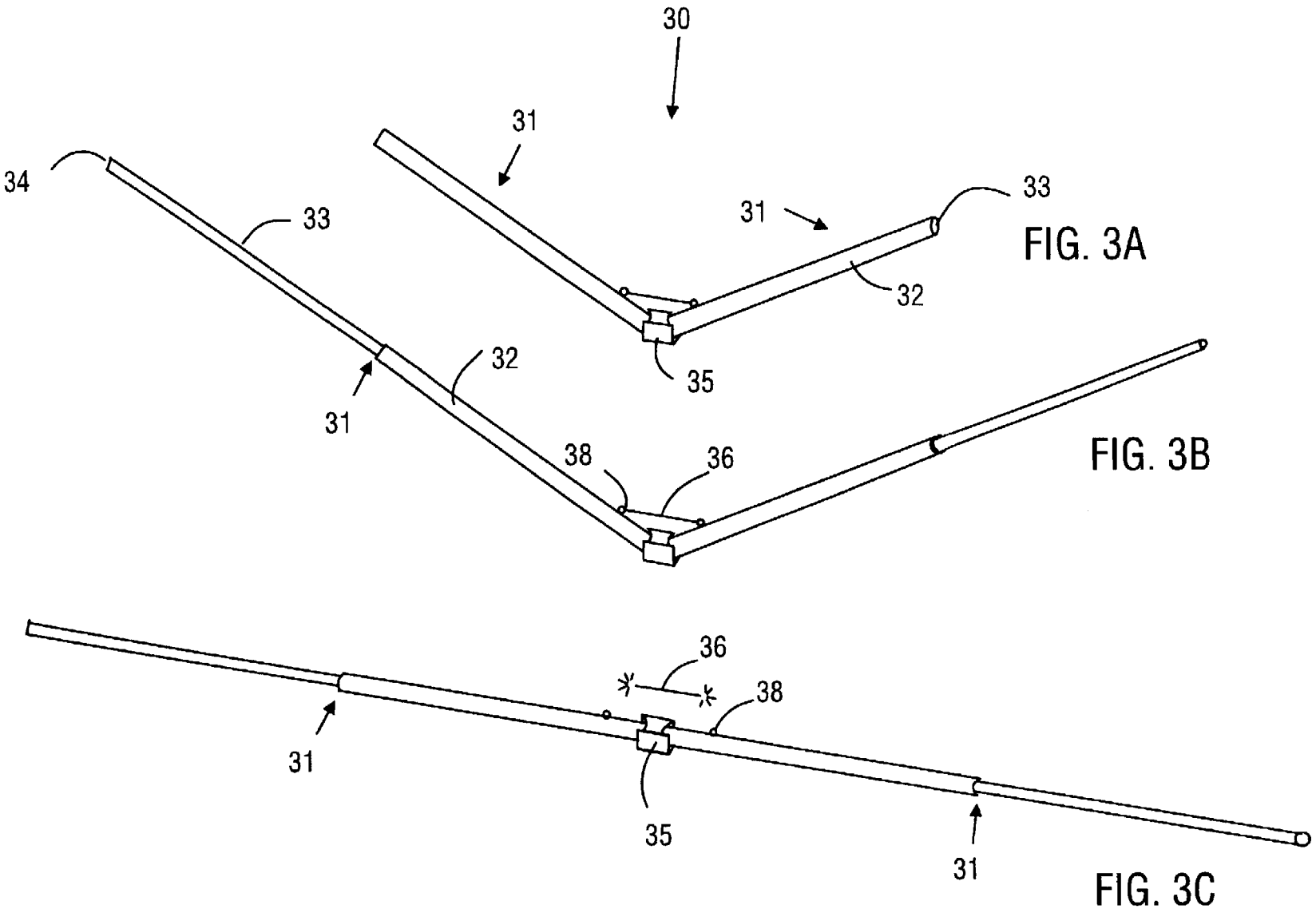
FIG. 3A, FIG. 3B and FIG. 3C show a telescoping dihedral forming member of the present invention in a non-extended position (FIG. 3A), in the configuration in which the system will be after expansion of the telescoping poles in flight (FIG. 3B), and in the configuration which the dihedral forming member will take upon the ground after deployment (FIG. 3C).

FIG. 3A, FIG. 3B, and FIG. 3C show the functioning of a preferred dihedral forming member 30 during operation. This is a telescoping dihedral forming member adapted to expand during deployment. For the purpose of clarity, the explosive array that would be attached to a plurality of these dihedral forming members 30 during use is not shown.

FIG. 3A shows the telescoping dihedral forming member 30 in pre-deployment form. Dihedral forming device 30 of two telescoping arms 31. Each telescoping arm 31 is comprised of outer tube 32 within which is disposed inner tube 33. Inner tube 33 has end 34. Explosive array 20 may be attached to dihedral forming member 30 at various points along outer tubes 32 and to end 34. Explosive array 20 can be attached to dihedral forming member 30 in any of a number of methods known to those of skill in the art, for example, with interface loops in the ISOC structure designed to allow the tubes to extend (freely slide) through the loops during extension. Two telescoping arms 31 are connected to central member 35. Central member 35 will typically comprise a system for generating the force necessary to deploy and power the expansion of the telescoping arms 31 dihedral forming member 30 during flight. In one preferred embodiment of dihedral forming member 30, each telescoping arm 31 is joined by a gas generator that generates the force required to deploy the telescoping arm. Such a gas generator assembly has been proven effective in the DEMNS system. Other mechanisms for expanding the telescoping arms comprise rocket, explosive and/or mechanical devices. Once the telescoping arm 31 is fully extended, it may be locked in the extended position by any of a number of methods, for example by internal gas pressure of the system or catches on the inner and outer tubes.

Only a single inner tube 33 and a single outer tube 32 comprise each telescoping arm 31 in FIG. 3. However, one of ordinary skill will recognize that 3, 4, or more tubes could be joined to form a telescoping arm. The DEMNS system has employed a telescoping tube comprising multiple inner tubes. In the DEMNS system, two telescoping arms, each comprising an outer tube and three internally telescoping tubes are attached in a fashion to a central gas generator. The outer tube is a 3" diameter tube having a 0.060" wall thickness. Thicknesses of telescoping tubes are calculated to match the ratio of forced area, and produce the same acceleration in each tube for a smooth, progressive deployment. The tubes of the telescoping arm may be sealed to each other internally by O-rings, which create air pockets that act as dampers. As the tubes extend under pressure from the gas generator, pockets between the O-rings become smaller, thus compressing the air inside and producing a retarding force. The gradually increasing pressure in the pockets close the tubes, reducing the force that is supplied to the end fittings. Telescoping arms of this construction have performed well in testing in the DEMNS system, and this design is adaptable to create a dihedral forming member for use in the present invention.

In the present invention, two telescoping arms 31 will be joined to center member 35 (which is the gas generator housing) at the required dihedral angle. The tubes will be held in a dihedral forming, fixed angular section prior to deployment, and through the expansion of the tubes during the deployment phase of the system. During deployment, as seen in FIG. 3B, the telescoping arms 31 will extend so that dihedral position of the laterally extended explosive array will be obtained. The dihedral forming, fixed angular section of the telescoping arms may be maintained by any of a number of mechanisms. For example, in FIG. 3A and FIG. 3B, a support bar 36 is attached to outer tubes 32 at points 38.

The expanding tubes, as with most of the dihedral-forming members contemplated by the present invention, will typically be designed so that the member substantially straightens out of the angular position prior to or upon impact of the aerially deployed structure with the ground. This prevents the angle of the dihedral forming member 30 from causing the array to lie unevenly along the ground. As previously discussed, it is important for arrays contemplated by the invention to obtain a flat, evenly spaced pattern on the target area. In FIG. 3C, support bar 36 detaches from points 38 at a desired time prior to or upon landing of the net. This allows the telescoping arms 31 to move out of the angular position and dihedral forming member 30 achieves a substantially straight position. This release of the telescoping arms can be achieved by a number of mechanisms, of which the easiest could be a simple release that is activated by the impact of the dihedral forming member with the ground. After a substantially straight position is achieved, and the net is on the ground, the munitions may be detonated. Of course, it is possible that a dihedral forming member will be deployed over uneven ground, and that the most ground-conforming position of the dihedral forming member is not absolutely straight. The important factor is that the dihedral forming member release from its fixed angle so that the most ground-conforming position possible for the explosive array may be achieved.

In some embodiments of the invention, the roll stabilizing influence of the dihedral can be enhanced by various aerodynamic enhancing devices 40. A simple aerodynamic device involves making the array solid. The impact of these small solid (closed) surfaces on the overall deployment process would be small. These solid surface array enhancements would be lift dominated and, hence, very sensitive to their local angle of attack. This roll stability enhancement is viewed as a potential trim adjustment option available to compensate for any uncertainties in the aerodynamics.

Aerodynamic enhancing device 40 can be any of a number of designs which provide lift control and can be employed to adjust the trim of the system as it is deployed through the air. In its simplest form, aerodynamic enhancing device 40 can be a thin material of film or fabric which is operably attached to localized areas of the array. This attachment can be done by any of a number of methods, including fusing the material to the bottom members of the explosive array. In the example of the ISOC net structure of FIG. 2, it would be possible to attach the material in a local area of the array with the same attachment assembly that is used to attach the bottom of the munition 22 to lower strapping member 24. In some ISOC embodiments, this is a grommet-type attachment, and the materials of the aerodynamic enhancing device could be positioned between the lower portion of the grommet and the lower strapping member. Alternatively, aerodynamic enhancing devices can be more elaborate, and include airfoil structures. For example, a solid airfoil structure could be operatively attached to the explosive array. Further, a non-rigid air foil formed of fabric designed to be inflated by the flow of the array through the air could be employed.

Typically, aerodynamic enhancement device 40 will be operably attached to the net in a proximity adjacent to a dihedral forming member 30. This allows for the lift forces of the aerodynamic enhancing device to impinge on the explosive array in substantially the same location as the spreading and lateral support forces of the dihedral forming members. Because the dihedral forming members will position the array in the most dihedral form in those areas adjacent the dihedral forming members, placing the aerodynamic enhancement device adjacent the dihedral forming member allows the extra lift to be concentrated in an area where the stabilizing forces of the dihedral are most concentrated.

Drag bridle 70 is used to attach any of a number of drag generating devices 80 to the aft end of array 20. These drag generating devices perform several functions. First, drag generating device 80 serves to prevent the aft end of array 20 from flapping as the structure is deployed through the air. Flapping is the result of variances in the lift and drag of the system coupled with the pull of gravity. Drag generating device 80 tensions the aft end of the array, and damps out much of the flapping. Further, drag generating device 80 can be employed to slow the forward motion of array 20 during deployment and bring the array to earth in an appropriate location over a minefield.

Drag generating device 80 can be any of a number of structures. In most of the embodiments pictured in the figures, drag generating device 80 is shown as a drag chute 82. Drag chutes are advantageous when an array 20 is being deployed over a long distance, or when a relatively sudden braking force is desired for the array. Drag chutes only function when the array is moving through the air and air is filling the chute. Therefore, drag chutes lose much of their effectiveness at slow speeds. Drag chutes can be deployed at any advantageous time during the deployment process, and can be "reefed," i.e., restrained in a semi-open position in order to moderate the amount of drag generated at a given point. Drag generating device 80 can also be a number of arresting devices. These arresting devices typically comprise a tethered line that is attached to drag bridle 70 and plays out behind array 20 after launch. The devices are usually made in such a manner that gradually increasing drag is placed on the aft end of the array. These arresting devices can be used to both slow the forward speed of the array, and to bring the array to the ground a set stand-off distance from the deployment platform. Examples of such arresting devices are: drum and cable drag generating systems, systems of Velcro® that has been joined and is gradually separated as it is pulled on by a line joining the Velcro® to drag bridle 70, and systems of webbing stitched together with burstable stitches which are designed to give way as force is applied via a line hooked to drag bridle 80. Each of these systems can be adapted to provide a gradually increasing arresting force to the array, and, ultimately, an absolute distance that the array is allowed to move forward before landing.

Figure 4A:
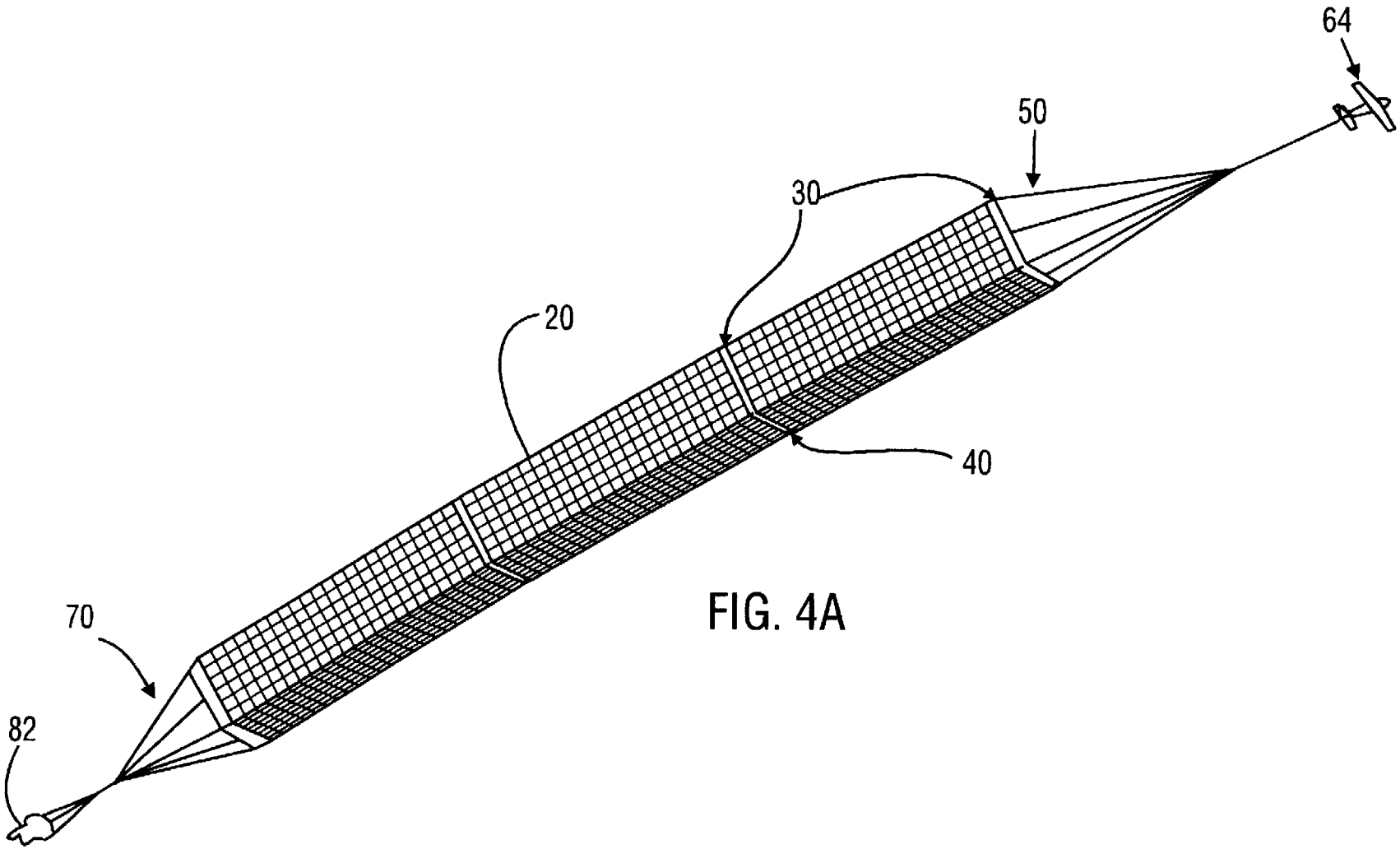
FIG. 4A, FIG. 4B, and FIG. 4C show various manners of deploying the aerially deployable structure of the present invention in a dihedral configuration.
Figure 4B:
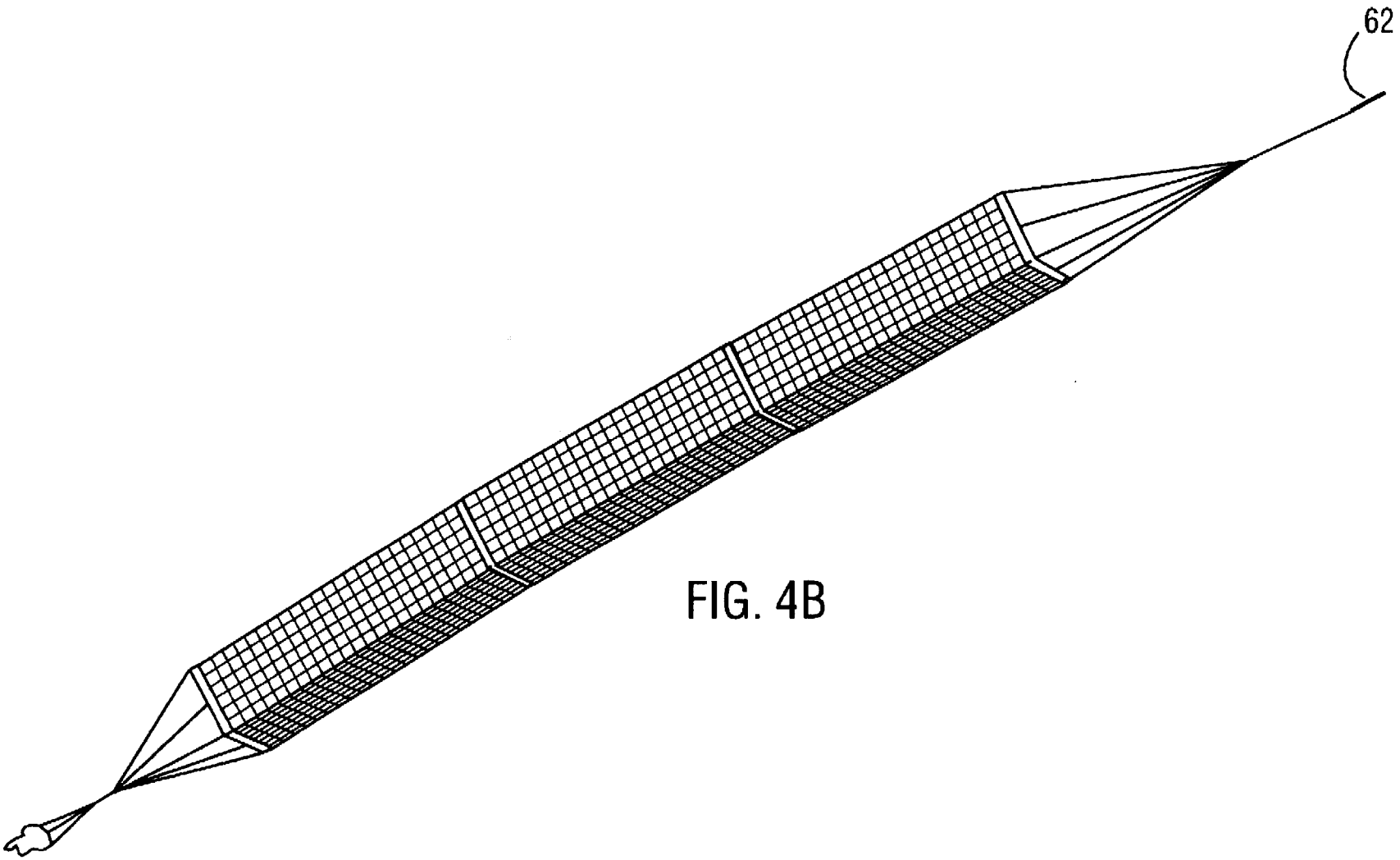
Figure 4C:
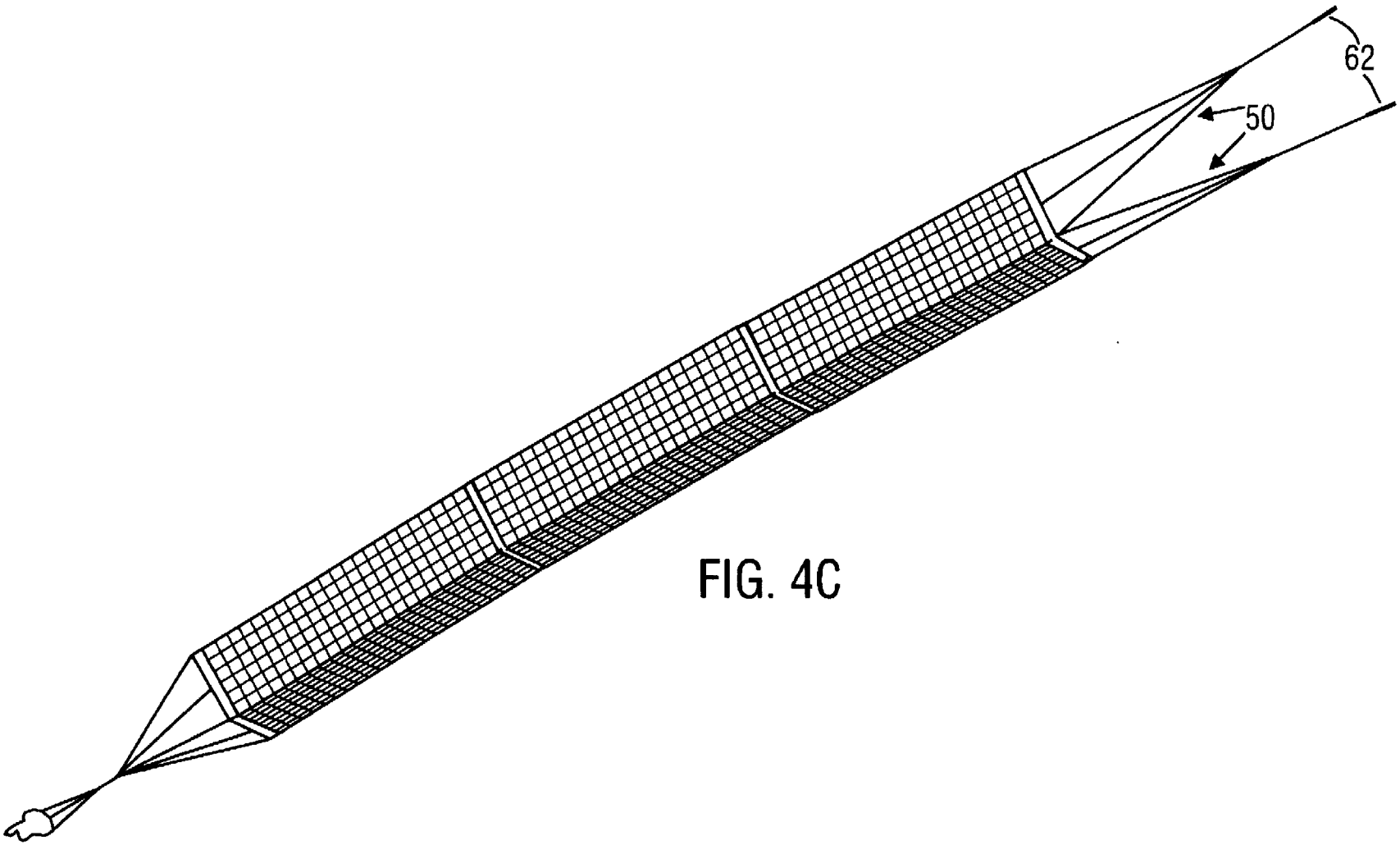

FIG. 4A, FIG. 4B and FIG. 4C show various manners in which the inventive structures can be towed. In FIG. 4A, airplane 64 tows variably deployable structure 10 through the air in a dihedral configuration. Airplane 64 is attached to explosive array 20 by tow bridle 50. Note that drag chute 82 is in a reefed configuration in these drawings. Drag chute 80 may be opened fully in order to slow the array quickly after deployment. Dihedral forming members 30 function to position explosive array 20 in a dihedral configuration during flight. Further, aerodynamic enhancing device 40 can be seen causing local lift in the array. It is anticipated that airplanes, drones, and the like will be used to deploy structures over relatively long flight distances of at least some miles.

FIG. 4B is essentially the same as FIG. 4A, with the exception that a rocket motor 62 has replaced airplane 64. It is o anticipated that rocket systems will be used to deploy explosive arrays over relatively short distances, for example the 10's to 100's of meters necessary to achieve a safe stand-off distance for a mine-clearing explosive array in a battlefield. Of course, larger rockets or missiles could be used to deploy arrays over greater distances. FIG. 4C shows the aerially deployable structure being towed by two rockets 62 attached to two tow bridles 50. While the dihedral configuration of the present invention allows for deployment via a single tow point, and the advantages of such a single tow point system, there is no reason o why dual tow points cannot be employed to pull a dihedrally configured array, as shown in FIG. 4C.

One of ordinary skill will realize that there are a variety of ways in which the aerially deployable structure can be deployed to attain the in-flight form in which it is seen in FIG. 1 and FIG. 4A, FIG. 4B and FIG. 4C. For mine clearing purposes, the explosive array net is typically designed to deploy from a container integrated in a trailer or mounted on a host platform. This scenario provides for compact transport of the mine-neutralizing device to the battlefield. This typically necessitates that the net be stowed with a lateral width of less than 2.4 meters and expanded during the deployment to 5 to 8 meters in width, the width to be cleared through a minefield in a typical battle arena. Therefore, for many battle deployment situations, telescoping or otherwise expanding dihedral forming members are employed. The structure may be thus, deployed in an initially compressed configuration and attain its full lateral spread during flight.

Alternatively, a structure can have solid dihedral forming members 30 which extend the full lateral width of the explosive array. Such fixed dihedral members prevent the need to expand the array during flight, and the incumbent technical difficulty and uncertainties involved. However, since the dihedral forming members can be 5 to 8 meters wide, transportability of a device having fully spread dihedral forming members in a stowed form within the battle arena is diminished. Therefore, it is contemplated that arrays of fixed full width dihedral forming members will be most useful in regard to structures which are towed aerially into the battle arena from a remote site. Attachment of the array to an aircraft can be achieved by a number of methods. For example, a device having full width dihedral forming members could be attached to an already flying airplane by any of a variety of known methods of hook, capture, and retrieval and then towed to the battlefield. Further, the arrays could be deployed from the rear of a plane, using a drag device to pull the array into a dihedral condition attached to tow bridal.

Figure 5A:
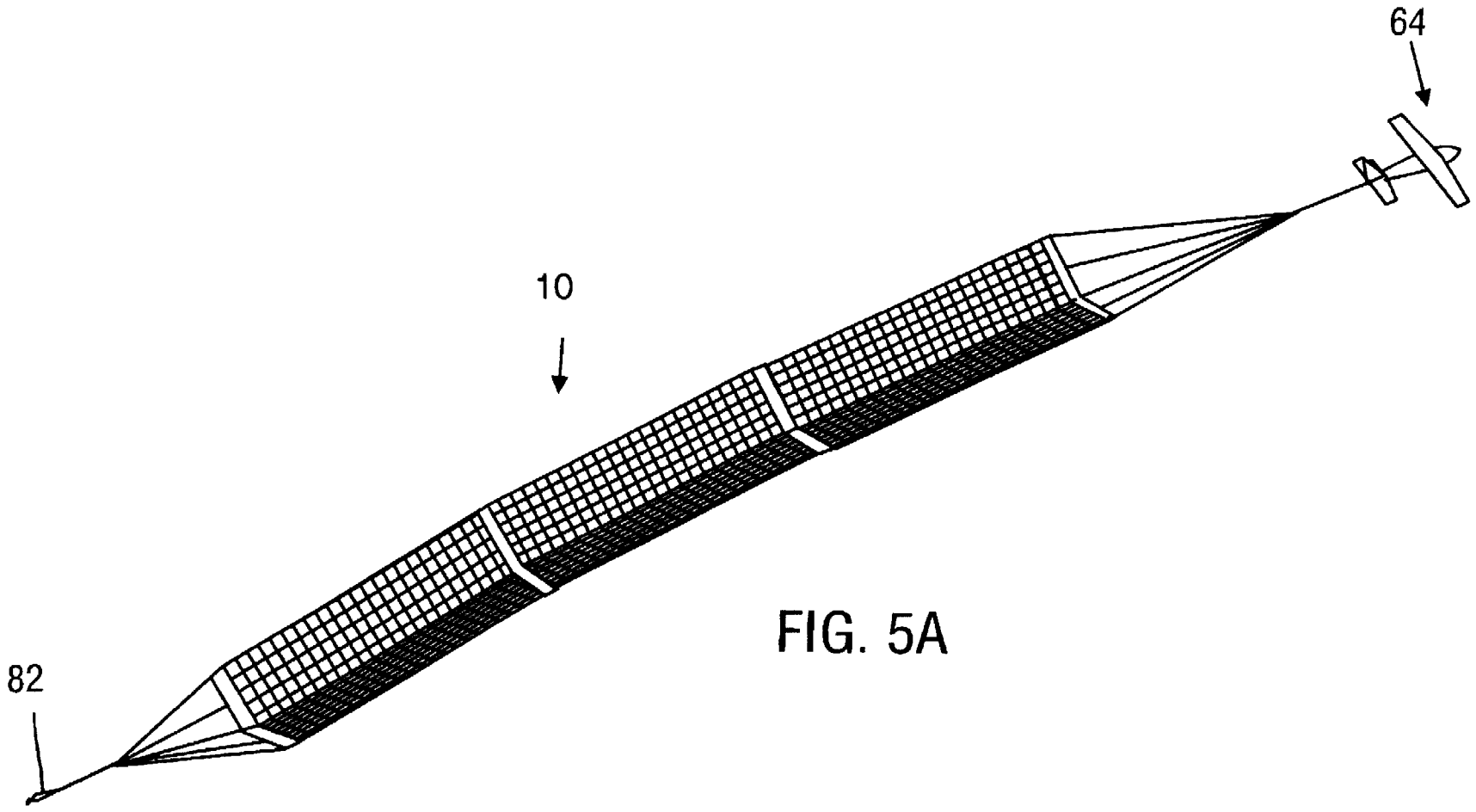
FIG. 5A, FIG. 5B, and FIG. 5C show one method of deploying the aerially deployable structure of the present invention with an airplane.
Figure 5B:
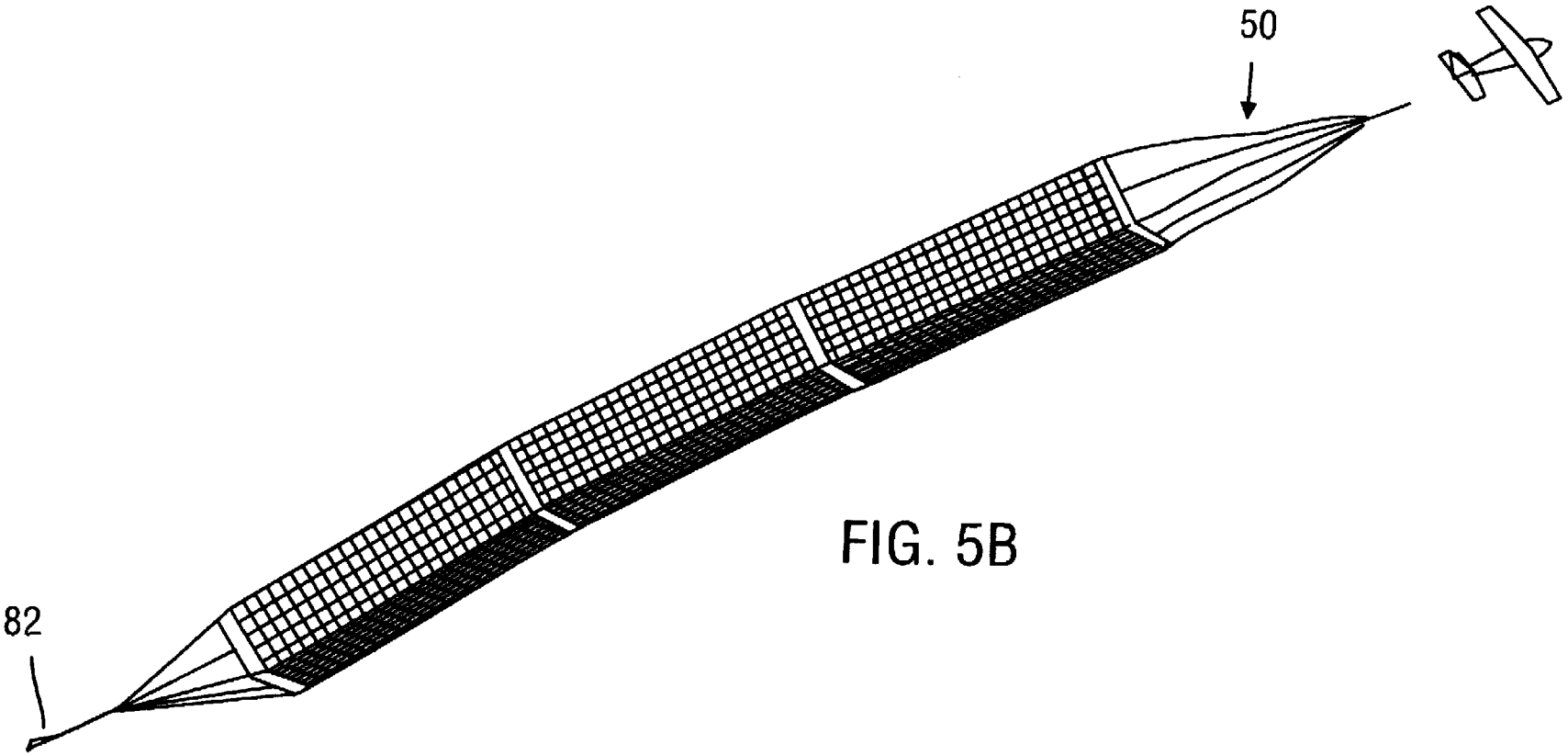
Figure 5C:
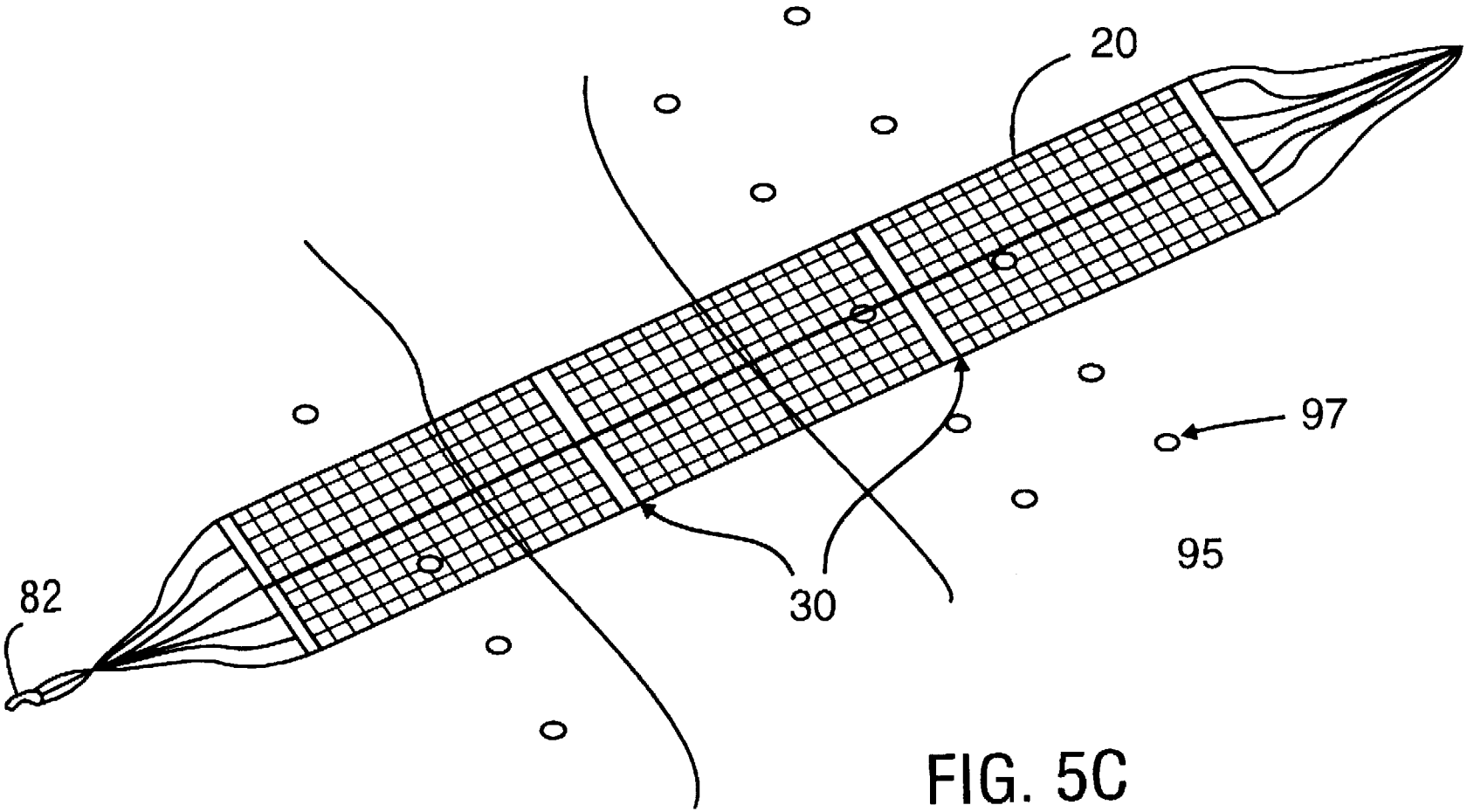

Airplane deployment is shown in FIG. 5A, FIG. 5B, and FIG. 5C. In FIG. 5A, airplane 64 is seen towing aerially deployable structure 10 towards minefield 95. Note that drag chute 82 is reefed at this time, to provide a stabilizing drag force at the aft end of array 20. In FIG. 5B, airplane 64 has released tow bridle 50, and drag chute 82 has fully extended to slow the structure and let it fall to earth. In FIG. 5C, structure 10 has fallen into position over minefield 95, which comprises mines 97. The dihedral forming members 80 have flattened, and the explosive array 20 is properly positioned. Detonation of the explosive array will then neutralize the mines underneath the array.

Another deployment system suitable for use with the present invention is discussed in U.S. Pat. No. 5,437,230, to Harris et al. This method of deployment involves the use of an air transportation vehicle, such as a glider or airplane, to deploy the array. In this system, the explosive array is designed to be spread by forward and aft net spreader assemblies. Deployment is accomplished out the rear of a forward moving air transportation vehicle. An extraction device, such as a drag chute, pulls the aft net spreader frame assembly from the rear of the air transportation vehicle. The force of the drag chute opens the aft net spreader frame and spreads the aft end of the explosive array. The explosive array is then pulled from the air transportation vehicle. The final structure deployed from the air transportation vehicle is the forward spreading frame, which is configured so that it is pulled open and spreads the forward portion of the explosive. The spread array then falls to the ground, where it can be exploded. U.S. Pat. No. 5,437,230 does not report the use of a dihedral configuration to maintain stability. However, once the invention of the present location is known, it is possible to adapt the system into a dihedral form and achieve a system of greater stability than that taught by the patent. This would be done by configuring the forward and aft net spreader assembled to form the dihedral configuration. This would typically involve placing a dihedral forming angle in each of the net spreader assemblies, and any other lateral supports of the net.

Two typical deployment methods for the invention will next be described so that the advantages of the invention can be understood and appreciated. The present invention is not limited to any particular deployment method or system, and it is not limited to mine-clearing applications.

EXAMPLE 2

Dihedral Deployment with Elongating Dihedral Forming Members

FIG. 6A, FIG. 6B, FIG. 6C and FIG. 6D illustrate a typical exemplary deployment sequence for an explosive array in a dihedral configuration according to the present invention. This sequence contemplates use of a rocket motor to deploy a mine-neutralizing explosive array within a battle arena.

In this preferred embodiment, a system according to the present invention may be packaged in a trailer system which can be towed. Host vehicle 94, will tow the trailer into the proper horizontal (azimuth) alignment to a position roughly 50–75 meters from the mere edge of the minefield. The launchers will be elevated and rocket motor 62 will deploy the explosive mine neutralization system over the minefield. The required stand-off (50–75 meters) and longitudinal explosive neutralization system expansion (e.g., 150–200 meters) is provided by the combination of the forward thrust of the tow motor and the arresting aerodynamic forces produced by drag chute 82. The lateral expansion (e.g., 5–8 meters) of the explosive neutralization system is provided by the activation of dihedral forming members 30.

Both longitudinal and lateral expansion of the explosive neutralization system is required to spread the explosive array over the required breach lane. Dihedral forming members 30 are used to effect lateral expansion. The dihedral forming members 30 in this preferred embodiment will be elongating dihedral forming members fixed in an angular configuration. The dihedral forming members may be telescoping tubes that may be expanded by inflation via generated gas, explosive means, mechanical means, or otherwise. For instance, the telescoping dihedral member of FIG. 3A, FIG. 3B, and FIG. 3C may be used. Drag chute 82, attached to the rear of explosive neutralization system by drag bridle 70, may be used to slow the trajectory until the array is fully longitudinally deployed and the open array settles over the minefield. After the array has settled, and dihedral forming members 30 have moved into a substantially straight configuration so that explosive array 20 lies substantially flat over minefield 95, the explosives may be detonated to neutralize any mines 97 under the array.

Figure 6A:
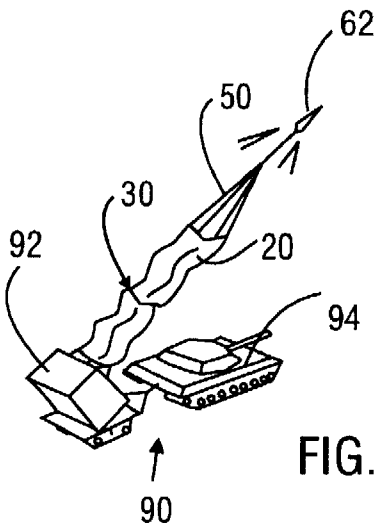
FIG. 6A, FIG. 6B, FIG. 6C, and FIG. 6D detail the deployment of a structure having the dihedral forming members such as those shown in FIG. 3 over a minefield.

In FIG. 6A, platform 90 comprises host vehicle 94 in trailer mounted container 92. Tow rocket 62 is shown pulling explosive array 20 out of container 92. Tow rocket 62 is connected to explosive array 20 by tow bridle 50. Note that the array is held in a dihedral form as it comes out of the deployment container.

Figure 6B:
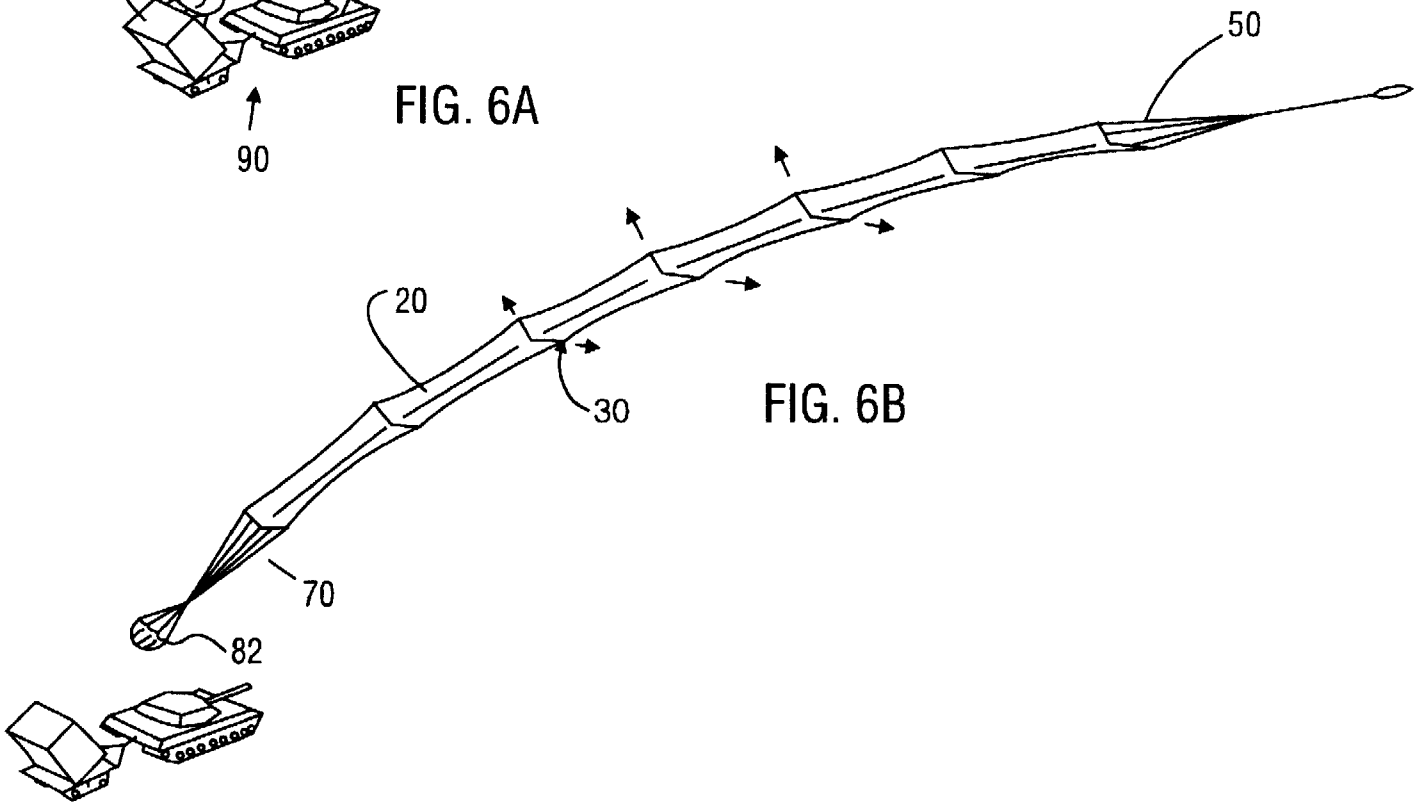

In FIG. 6B, explosive array 20 can be seen completely separated from container 92. Drag chute 82, which is attached to drag bridle 70 provides drag at the back end of explosive array 20 to ensure that it stays completely stretched out as it is pulled over minefield 95. Dihedral forming members 30, which were originally in a compact position, can be seen in the process of expanding from their short configuration to their fully extended telescoping configuration as demonstrated in FIG. 3B. As this lateral expansion occurs, the explosive array maintains the dihedral configuration.

Figure 6C:
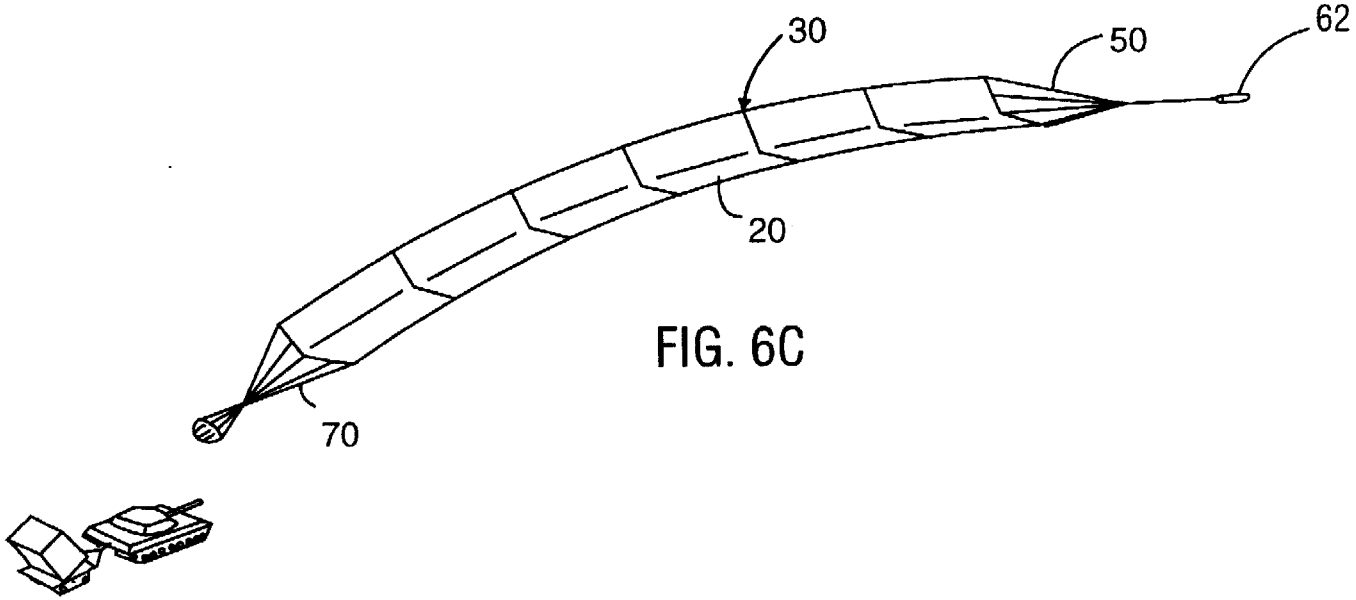
Figure 6D:
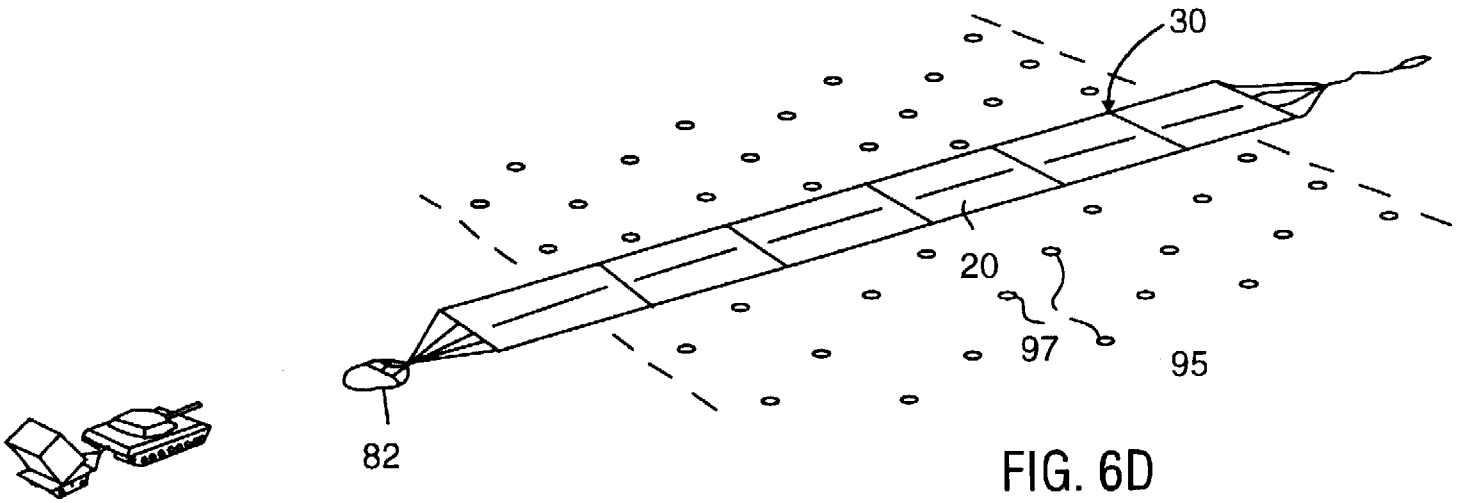

In FIG. 6C, full expansion of the explosive array has occurred. Longitudinal expansion has been caused by the action of tow rocket 62 at the front end of the array and drag chute 82 at the back end of the array. Lateral expansion has been affected by the operation of the dihedral forming members 30. Lateral expansion of the dihedral forming members 30 may be affected with any of the embodiments described herein. In FIG. 6C, the array is shown in ballistic flight prior to landing over the minefield. During this portion of the flight the dihedral configuration continues to stabilize the deployment of the array. FIG. 6D shows explosive array 20 having settled down on the minefield. Note that the angle has been removed from dihedral forming members 30 so that they are substantially straight. This causes the explosive array 20 to lie relatively flat over minefield 95. Note that platform 90 is located at safe stand off distance away from the edge of minefield 95 and the trailing edge of explosive array 20. As soon as the explosive array 20 is laid over minefield 95, it can be detonated in order to clear a path through the minefield for transportation of personnel and equipment.

In some embodiments of the invention, array 20 is designed to be compressible and flexible such that the munitions can be moved into a closely spaced arrangement and the compressed array may be folded into container 92. Packing material, such as paper or film, may be used to separate layers of the explosive array 20 as it is folded into container 92 for storage and transport. That packing material prevents entanglement or other fouling of the array that might prevent proper deployment.

EXAMPLE 3

Dihedral Deployment With Lateral Expansion Devices

Figure 7A:
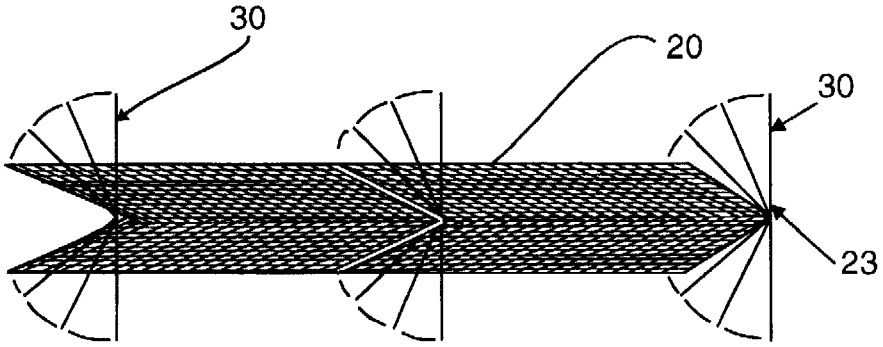
FIG. 7A, FIG. 7B, FIG. 7C and FIG. 7D show deployment of a structure of the present invention employing lateral expansion devices.
Figure 7B:
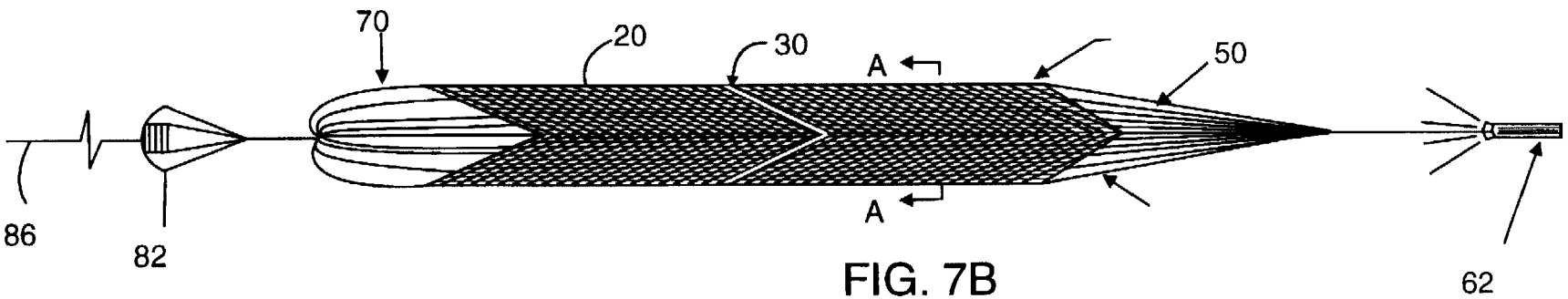
Figures 7C, 7D:
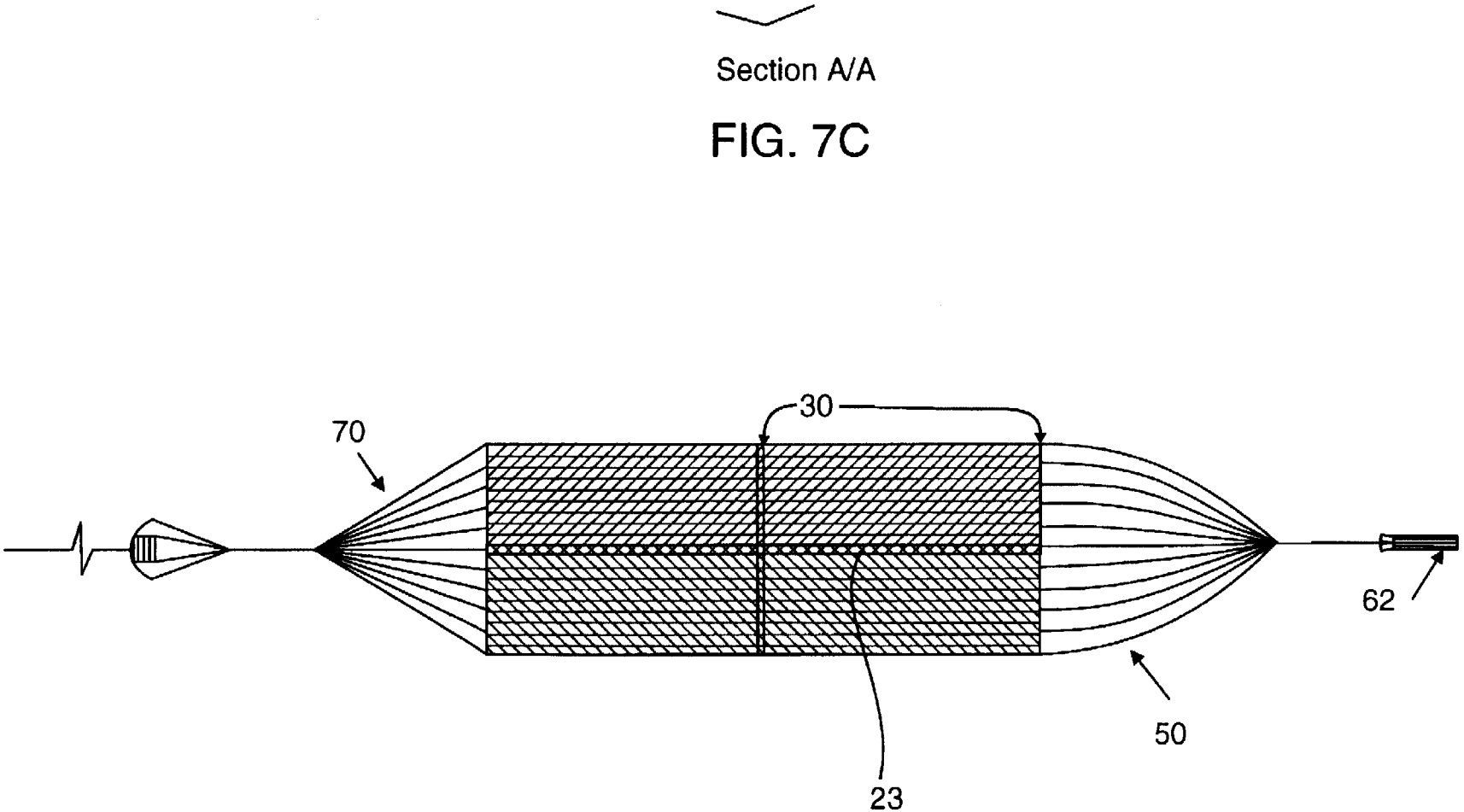
Figure 8A:
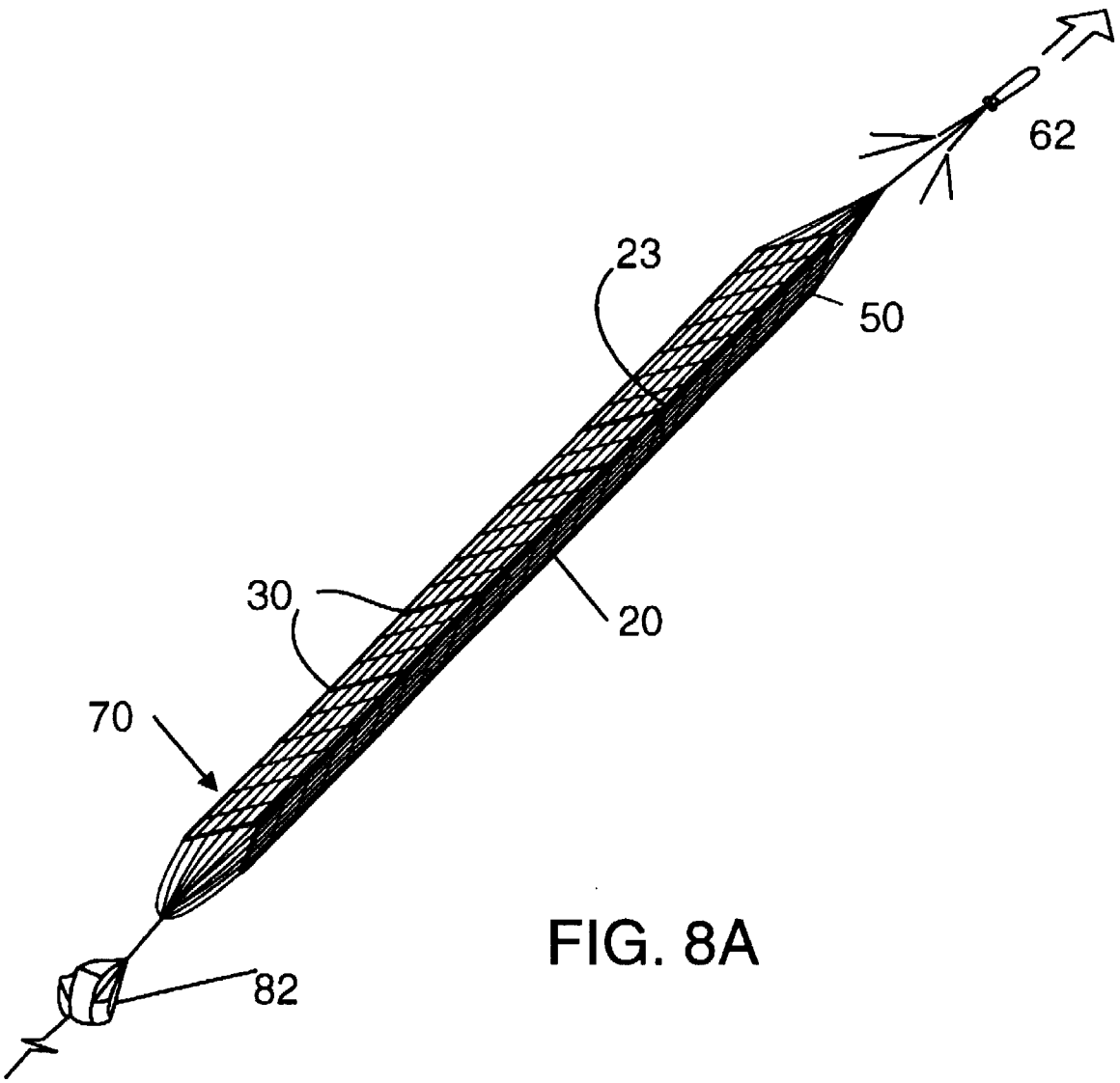
FIG. 8A, FIG. 8B and FIG. 8C show another view of the deployment of the lateral expansion device embodiment of the invention.
Figure 8B:
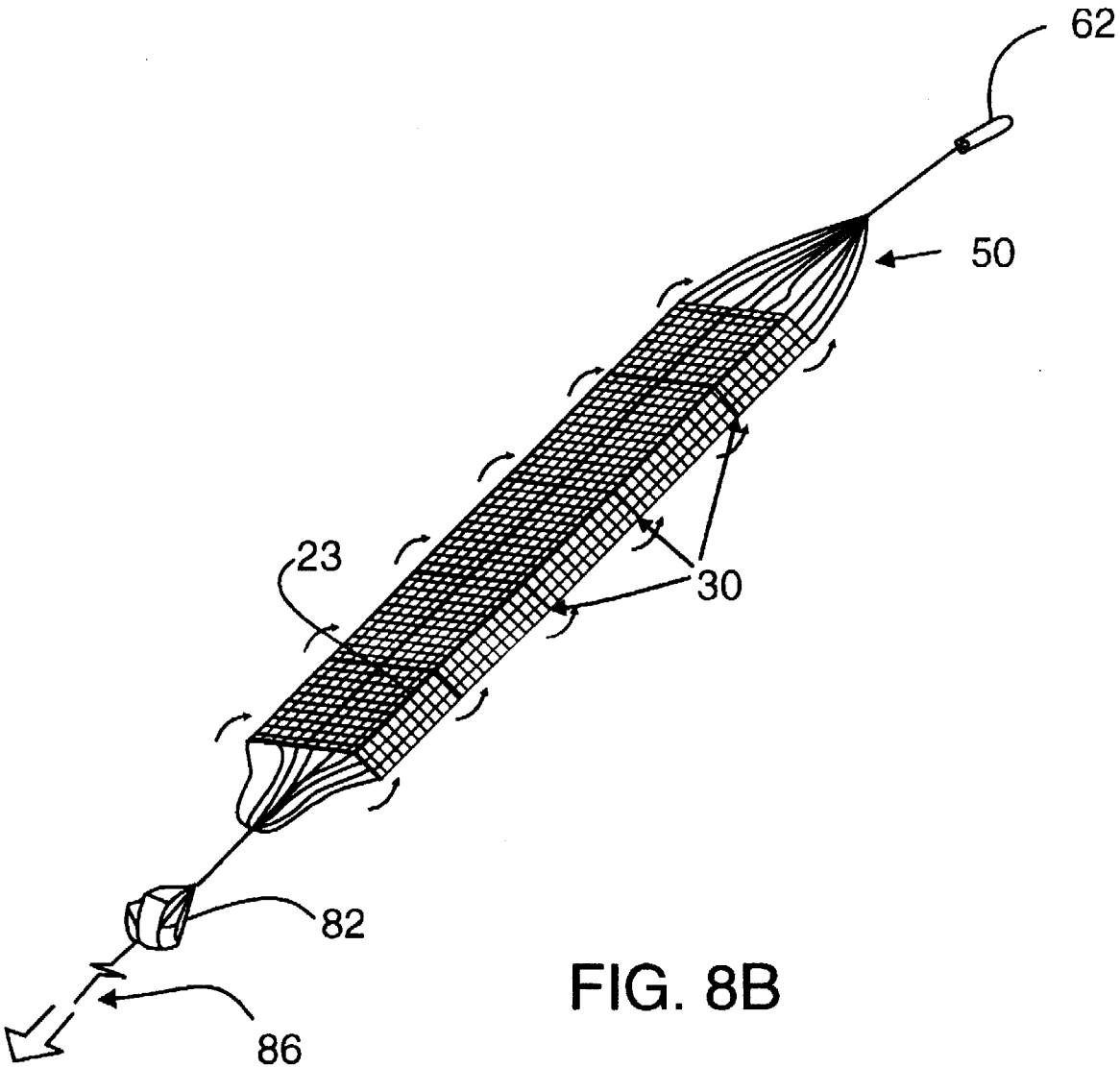
Figure 8C:
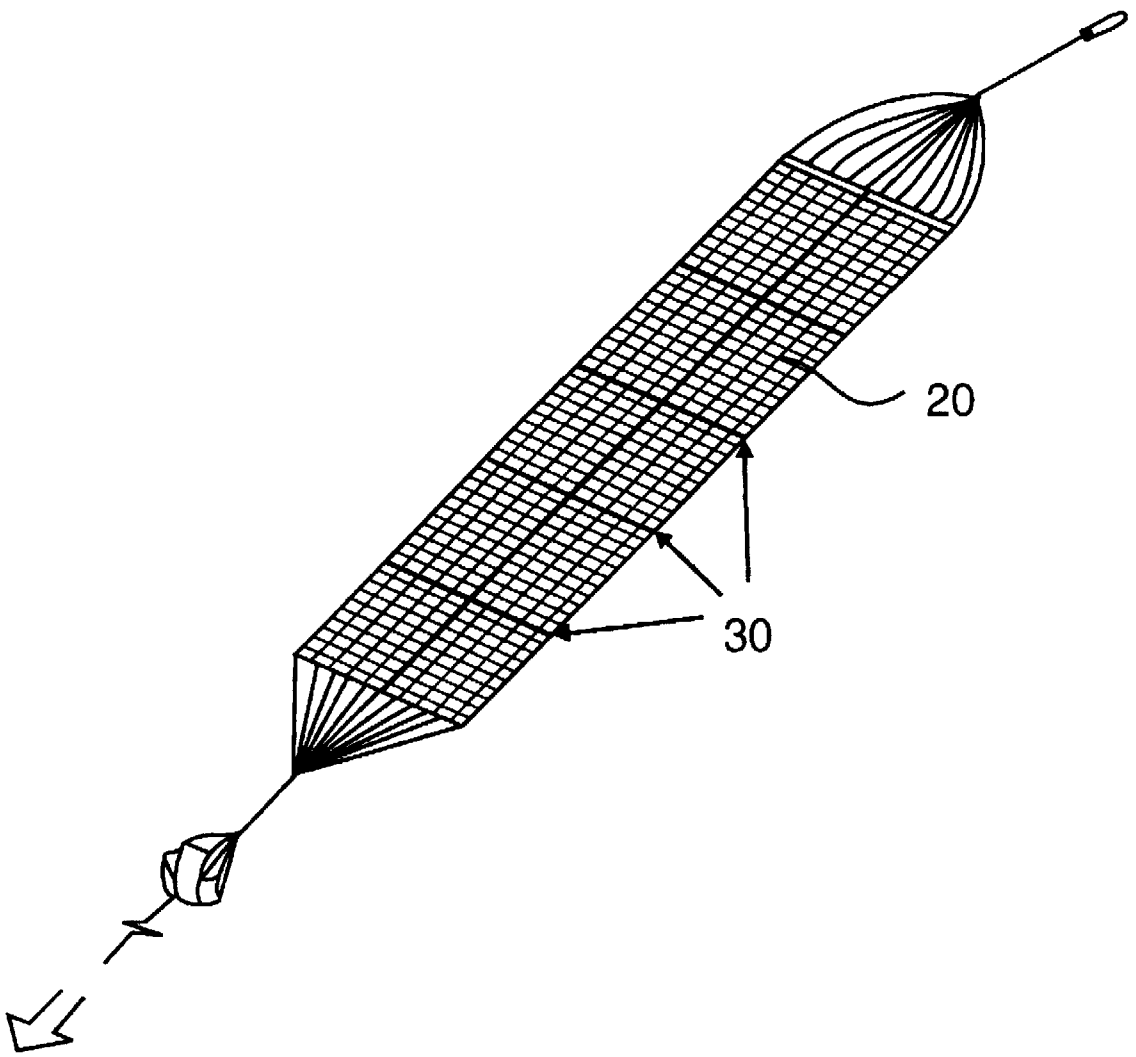

FIG. 7A, FIG. 7B, FIG. 7C, and FIG. 7D and FIG. 8A, FIG. 8B, and FIG. 8C show the functioning of a system employing LED-type dihedral forming members. The LED-type dihedral forming members may be utilized to provide both the dihedral in-flight stability and the lateral spreading of an explosive array 20 according to the present invention. FIG. 7A, FIG. 7B, and FIG. 7D show a top view of the functioning of the system; note that, for the sake of clarity, only three LED-type dihedral forming members are shown in these drawings, although many more could be used. FIG. 7C shows a sectional view of the system through the configuration shown in FIG. 7B. FIG. 8A, FIG. 8B and FIG. 8C shows a more oblique view.

This deployment system configures the munition array as a dihedral for low drag, stable flight during the powered flight phase of the deployment sequence through the use of LED-type dihedral forming members 30. After rocket burn-out (coasting phase), the inertia of the system combined with arresting forces produced by the drag chute (or tether) cause the array to achieve a planar configuration at its fully extended width before it lands on the ground. This deployment system can be used for close or over-the-horizon deployment of an array of mine clearing munitions or other objects.

FIG. 7A shows that dihedral forming members 30 are hinged LEDs attached to explosive array 20, with the hinge positioned adjacent center line 23. The LED's are capable of straightening or bending at their hinge so as to spread the explosive array by assuming fully a straight configuration or form a dihedral by assuming an angular position.

During powered flight phase, shown in FIG. 7B and FIG. 8A, rocket motor 62 pulls the array 20 and associated equipment out of a storage and transport container (not shown). The array is coupled to a plurality of LED-type dihedral forming members 30 which comprise pairs of beams extending from the centerline 23 of the array to the lateral edges of the array, hinged at the centerline of the array. LED-type dihedral forming members 30 may be designed to elongate after launch of the system by employing the telescoping or inflating techniques discussed previously, although this is not required or shown in the figures. The tow bridle 50 connects the array 20 to the rocket motor 62. The tow bridle is designed to tow the array in a dihedral arrangement, with the hinged LED-type dihedral forming members 30 forming obtuse angles during flight, the ends of each lateral expansion device being "swept back" during the powered flight phase as shown in FIG. 7B and FIG. 8A. This is accomplished by making the outer lines of the tow bridle 50 longer than would be required to straighten the LED-type dihedral forming member 30 combined with properly attaching the LED-type dihedral forming members 30 to the array 20.

The leading LED-type dihedral forming member 30 connects the tow bridle to the explosive array and experiences the highest loads during deployment. Flight loads on the leading LED-type dihedral forming member are complex. The initial deployment generated loads on the forward LED-type dihedral forming member are a function of the velocity of the deployment system when the first LED-type dihedral forming member is first pulled, the total compliance of tow bridle 50, and the bridle line density. The rocket motor initial loads will tend to collapse the leading LED-type dihedral forming member from its initial angle. Detailed analysis of a particular system is required to calculate the bending moment loads in the LED-type dihedral forming member. A compression spar can be added on the leading LED-type dihedral forming member to resist these loads, and maintain the dihedral-forming angle of the LED-type dihedral forming device 30 during the early stage of deployment. This compression spar can be designed so that it does not impend the ultimate straightening of the dihedral forming member during deployment.

As seen in FIG. 8B, when the rocket motor 62 burns out, the tow bridle 50 goes slack and a decelerating force is applied by the drag chute 82 and static line 86 through the drag bridle 70. The array bridle 70 is configured to cause the hinged LED-type dihedral forming members 30 to straighten out as shown in FIG. 7D and FIG. 8C. In particular, during the coasting or inertial phase of the deployment flight, the center-most line of the drag bridle 70 tightens before the outer lines, causing the outer ends of the lateral expansion devices to move forward relative to the centerline 23 of the array 20 such that each LED-type dihedral forming member forms a substantially straight line across the array, causing the array to expand and flatten. The hinges of the LED-type dihedral forming members 20 may be designed to lock into position when they straighten during this phase to ensure that the array maintains its fully expanded configuration during landing.

EXAMPLE 4

Testing of the Dihedral Configuration

Testing of dihedrally configured arrays is ongoing. Initial tests have proven the viability and success of the invention.

The inventors have built a sub-scale model of the array and used it to perform deployment tests and demonstrate the stabilization benefits of a dihedral. The sub-scale model simulated array porosity and dihedral. The array was pulled from a stowed (folded) state by a single pneumatic rocket attached to the array via a bridle. The aft end of the array was tethered to a ground point with an elastic line arrestor. Tests were conducted with and without the arrestor tether. In all tests, the array deployed and quickly stabilized with no roll or twist and landed correctly. Tests were also conducted that had the array dihedral oriented upside down. Those tests in which the array was stowed and deployed upside down very quickly rolled over to the correct orientation before landing.

The tests on the array undertaken thus far have proven the viability of the invention. The inventors are in the process of constructing full-scale arrays for flight-testing and further fine-tuning of the designs.

In accordance with long-standing convention, the words "a" and "an," when used in conjunction with the transition "comprising " in the claims, denote "one or more."

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. In particular, this invention is not to be construed as limited to mine clearing applications, although that is a presently preferred application for the invention. Various changes may be made in the shape, size, and arrangement of parts. For example, equivalent elements or materials may be substituted for those illustrated and described herein, and certain features of the invention may be utilized independently of the use of other features, all as would be apparent to one skilled in the art after having the benefit of this description of the invention.

What is claimed is:

1. An aerially deployable mine neutralizing system, comprising:

a plurality of jet-type munitions, each having a top and bottom end, disposed in a preselected pattern and having preselected spacing and orientation for deployment over a mine field;

a support structure for supporting the munitions during deployment such that the preselected spacing and orientation of the munitions is attained after deployment; and a dihedral forming member operably connected to the support structure and adapted to position the structure in a substantially dihedral configuration during deployment.

2. The structure of claim 1, wherein the support structure is coupled to the top end of each munition and to the bottom end of each munition so as to control the orientation of the munitions.

3. The structure of claim 1, wherein the support structure comprises:

a generally planar network of flexible upper strapping members connected to the top ends of the munitions; and a generally planar network of lower flexible strapping members connected to the bottom ends of the munitions.

4. The array of claim 1, wherein the support structure includes a detonator to provide detonating energy to each munition.

5. An aerially deployable minefield clearing system comprising an explosive array, and at least one dihedral forming member connected to the array, the dihedral forming member adapted to position the array in a substantially dihedral configuration during deployment.

6. The aerially deployable system of claim 5, having at least two dihedral forming members.

7. The aerially deployable system of claim 5, wherein the dihedral forming member has a fixed angle section.

8. The aerially deployable system of claim 5, wherein the dihedral forming member is hinged.

9. The aerially deployable system of claim 5, wherein the dihedral forming member is a telescoping member having a fixed angle section.

10. The aerially deployable system of claim 5, wherein the dihedral forming member is adapted to become substantially straight during landing whereby that the array lays substantially flat on landing.

11. The aerially deployable system of claim 5, wherein the dihedral forming member is adapted to retain a fixed angle configuration during deployment and said dihedral forming member is adapted to become substantially straight ailing landing whereby the array lays substantially flat on landing.

12. The aerially deployable system of claim 5, wherein the dihedral forming member is a lateral expansion device mechanism adapted to use energy from a towing system to position the array in a substantially dihedral configuration while being aerially towed.

13. The aerially deployable system of claim 5, wherein the array is substantially planar and adapted to form a dihedral during deployment.

14. The aerially deployable system of claim 5, wherein the array includes individual munitions.

15. The aerially deployable system of claim 14, wherein the individual munitions are jet-type munitions.

16. The aerially deployable system of claim 14, having a detonating system operatively connected to the munitions.

17. The aerially deployable system of claim 5, wherein the explosive array comprises detonating cord.

18. The aerially deployable system of claim 5, wherein the explosive array is a munition array capable of neutralizing mines in a mine field, comprising:

an array of jet-type munitions, each having a top and bottom end;

a generally planar network of flexible upper strapping members connected to the top ends of the munitions;

and a generally planar network of lower flexible strapping members connected to the bottom ends of the munitions.

19. The aerially deployable system of claim 18, wherein the upper strapping members are fastened to the lower strapping members at locations between the munitions.

20. The aerially deployable system of claim 5, having one or more tow points attached to the explosive array.

21. The aerially deployable system of claim 20, having only one tow point attached to the array.

22. The aerially deployable system of claim 5, wherein the system is adapted to be towed by an aircraft.

23. The aerially deployable system of claim 22, wherein the aircraft is a rocket.

24. The aerially deployable system of claim 22, wherein the aircraft is an airplane.

25. The aerially deployable system of claim 5, wherein the system is designed to be deployed from an aircraft.

26. The aerially deployable system of claim 25, wherein the system is designed to be pulled out of an aircraft by a drag-generating device attached to the explosive array.

27. The aerially deployable system of claim 5, wherein the system comprises at least one aerodynamic enhancing member operatively linked to the array.

28. The aerially deployable system of claim 27, wherein the aerodynamic enhancing member is a panel of material.

29. The aerially deployable system of claim 27, wherein aerodynamic enhancing member is an airfoil.

30. The aerially deployable system of claim 27, wherein the aerodynamic enhancing member is attached adjacent a dihedral forming member.

31. An aerially deployable mine neutralizing system comprising a dihedral forming system adapted to position the system in a substantially dihedral configuration during deployment.

32. The aerially deployable system of claim 31, having explosives for neutralizing mines.

33. The aerially deployable system of claim 32, having a detonator for the explosives.

34. The aerially deployable system of claim 31, further defined as comprising a motion generating source for moving the system through the air.

35. The aerially deployable system of claim 34, wherein the motion generating source is a powered towing system.

36. The aerially deployable system of claim 35, wherein the powered towing system is attached to the system at a single tow point.

37. A method of aerially deploying an explosive system comprising: providing a system to be aerially deployed, said system comprising at least one dihedral forming system adapted to position the system in a substantially dihedral configuration during deployment;

attaching said system to an aircraft; and using said aircraft to deploy the system by positioning the system in a dihedral configuration during deployment.

38. The method of claim 37, wherein the aerially deployable system further comprises an array of explosive munitions operably linked to the dihedral forming member.

39. The method of claim 37, wherein the array of explosive munitions includes:

an array of jet-type munitions, each having a top and bottom end;

a generally planar network of flexible upper strapping members connected to the top ends of the munition;

and a generally planar network of lower flexible strapping members connected to the bottom ends of the munitions.

40. The method of claim 39, wherein the upper strapping members are fastened to the lower strapping members at locations between the munitions.

41. The method of claim 37, wherein the aerially deployable system comprises at least two dihedral forming members.

42. The method of claim 37, wherein the aircraft is used to tow the system by only one tow point.

43. The method of claim 37, including the step of deploying the system by pulling the system out of the aircraft with a drag-generating device.

44. The method of claim 37, including the step of providing least one aerodynamic enhancing member operatively linked to the system.

* * * * *

UNITED STATES PATENT AND TRADEMARK OFFICE

CERTIFICATE OF CORRECTION

| | | |
|---|---|---|
| PATENT NO. | : | 5,675,104 |
| DATED | : | October 7, 1997 |
| INVENTOR(S) | : | Schorr et al. |

It is certified that error appears in the above-identified patent and that said Letters Patent is hereby corrected as shown below:

In claim 11, column 18. line 17, delete "ailing" and insert --during-- therefor.

Signed and Sealed this

Sixteenth Day of December, 1997

*Attest:*

Bruce Lehman

BRUCE LEHMAN

*Attesting Officer*

*Commissioner of Patents and Trademarks*